US008960684B2

(12) United States Patent
Isechi et al.

(10) Patent No.: US 8,960,684 B2
(45) Date of Patent: Feb. 24, 2015

(54) INTERNAL COMBUSTION ENGINE HAVING POSITIONING PINS DISPOSED WITHIN FLUID COMMUNICATION PORTS

(71) Applicant: Yamaha Hatsudoki Kabushiki Kaisha, Iwata-shi, Shizuoka (JP)

(72) Inventors: Tetsuji Isechi, Shizuoka (JP); Jyouji Sawaoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/264,222

(22) Filed: Apr. 29, 2014

(65) Prior Publication Data

US 2014/0345549 A1 Nov. 27, 2014

(30) Foreign Application Priority Data

May 23, 2013 (JP) ..... 2013-108644

(51) Int. Cl.
*F02F 1/10* (2006.01)
*F02B 61/02* (2006.01)
*F02F 7/00* (2006.01)

(52) U.S. Cl.
CPC ..... *F02F 1/102* (2013.01); *F02B 61/02* (2013.01); *F02F 1/10* (2013.01); *F02F 7/0082* (2013.01)
USPC ..... 277/637; 123/41.79; 123/196 R; 277/591; 277/598

(58) Field of Classification Search
CPC ..... F02F 1/102; F02F 1/10; F02F 7/0082; F02B 61/02; F16J 15/16
USPC ..... 123/41.72, 41.74, 41.79, 41.81 R, 196 R, 123/195 R; 277/591, 598, 637
See application file for complete search history.

(56) References Cited

U.S. PATENT DOCUMENTS

| | | | | |
|---|---|---|---|---|
| 5,852,992 | A * | 12/1998 | Boggs et al. | 123/196 R |
| 6,223,702 | B1 * | 5/2001 | Achenbach et al. | 123/41.71 |
| 6,223,709 | B1 * | 5/2001 | Takahashi | 123/193.5 |
| 6,837,208 | B2 * | 1/2005 | Satou | 123/195 R |
| 7,322,320 | B2 * | 1/2008 | Sugano | 123/41.84 |
| 2006/0102110 | A1 * | 5/2006 | Takenaka et al. | 123/41.82 A |

FOREIGN PATENT DOCUMENTS

JP 02-20416 Y2 6/1990

* cited by examiner

*Primary Examiner* — Noah Kamen
*Assistant Examiner* — Grant Moubry
(74) *Attorney, Agent, or Firm* — Keating & Bennett, LLP

(57) ABSTRACT

A motorcycle includes a cylinder body, a cylinder head disposed above the cylinder body, and a plurality of dowel pins configured to position the cylinder body and the cylinder head. The cylinder body includes a plurality of cylinders and a plurality of bolt insertion holes. The cylinder head includes first and second passages configured to flow oil or air therethrough. The cylinder body includes a first communication port in communication with the first passage and a second communication port in communication with the second passage. The first communication port is disposed in a front left region, and the second communication port is disposed in a rear right region. The plurality of dowel pins consist of a first dowel pin fitted into the first communication port and the first passage and a second dowel pin fitted into the second communication port and the second passage.

11 Claims, 27 Drawing Sheets

INTERNAL COMBUSTION ENGINE HAVING POSITIONING PINS DISPOSED WITHIN FLUID COMMUNICATION PORTS

BACKGROUND OF THE INVENTION

1. Field of the Invention

The present invention relates to motorcycles.

2. Description of the Related Art

Conventionally, an internal combustion engine for motorcycles in which a cylinder head and a cylinder body are formed separately from each other has been known. The cylinder head and the cylinder body are secured to each other by bolts inserted in bolt insertion holes that are formed in their mounting surfaces. Connection of the cylinder head and the cylinder body requires high precision because it greatly affects the performance of the internal combustion engine. For this reason, dowel pin holes, in which dowel pins configured to perform positioning are to be inserted, are formed in the mounting surfaces of the cylinder head and the cylinder body.

In addition, various members including the cylinder head and the cylinder body have an oil passage through which oil for lubricating the components disposed in these member flows. Since it is necessary to form the bolt insertion holes, the dowel pin holes, and the oil passage separately in the mounting surfaces, the size of the mounting surfaces tends to become large. The size increase of the mounting surfaces leads to an increase of the weight of the internal combustion engine. Japanese Examined Utility Model Publication No. H02(1990)-020416 discloses an internal combustion engine in which hollow positioning pins and oil passages are disposed coaxially with each other.

However, in the technique disclosed in Japanese Examined Utility Model Publication No. H02(1990)-020416, sufficient space for forming the hollow positioning pins and the oil passages is required in the regions to the right of the rightmost cylinder, between the cylinders, and to the left of the leftmost cylinder, because the hollow positioning pins and the oil passages are disposed coaxially. As a consequence, the size of the mounting surface of the cylinder body tends to become large.

SUMMARY OF THE INVENTION

In view of the foregoing and other problems, preferred embodiments of the present invention provide a motorcycle that achieves efficient layout of a mounting surface of a cylinder body and also prevents an internal combustion engine from increasing in size.

According to a preferred embodiment of the present invention, a motorcycle includes an internal combustion engine including a cylinder body including a plurality of cylinders arranged transversely, a cam chain chamber accommodating a cam chain and being positioned to the left of the leftmost one of the plurality of cylinders or to the right of the rightmost one of the plurality of cylinders, a coolant passage surrounding the plurality of cylinders to flow coolant therethrough, and a plurality of bolt insertion holes located around the coolant passage and receiving bolts; an engine member including a cylinder head disposed above the cylinder body or a crankcase disposed below the cylinder body, the engine member being secured to the cylinder body by the bolts and including first and second passages configured to flow at least one of oil and air therethrough; and a plurality of dowel pins configured to position the cylinder body and the engine member, wherein the cylinder body includes a mounting surface fitted to the engine member, a first communication port opening in the mounting surface and being in communication with the first passage, and a second communication port opening in the mounting surface and being in communication with the second passage; where, in the mounting surface of the cylinder body, a linear line passing through an axial center of the plurality of cylinders is defined as a first linear line, a linear line passing through the midpoint of the axial center of the leftmost cylinder and the axial center of the rightmost cylinder and being perpendicular or substantially perpendicular to the first linear line is defined as a second linear line, a region that is in front of the first linear line and to the left of the second linear line is defined as a front left region, a region that is behind the first linear line and to the left of the second linear line is defined as a rear left region, a region that is in front of the first linear line and to the right of the second linear line is defined as a front right region, and a region that is behind the first linear line and to the right of the second linear line is defined as a rear right region, the first communication port is disposed in the front left region and the second communication port is disposed in the rear right region, or the first communication port is disposed in the front right region and the second communication port is disposed in the rear left region; and the plurality of dowel pins consist of a first cylindrical dowel pin fitted into the first communication port and the first passage and a second cylindrical dowel pin fitted into the second communication port and the second passage.

In the motorcycle according to a preferred embodiment of the present invention, the first communication port of the cylinder body is in communication with the first passage to flow at least one of oil and air therethrough, and the first dowel pin configured to provide positioning is fitted into the first communication port. The second communication port of the cylinder body is in communication with the second passage to flow at least one of oil and air, and the second dowel pin configured to provide positioning is fitted into the second communication port. In this way, the same holes are used both to provide a positioning function and to flow oil and the like. Therefore, it is not necessary to form separate holes for these purposes. As a result, the layout of the cylinder body is designed and manufactured much more efficiently, and the mounting surface of the cylinder body is prevented from increasing in size. Moreover, the first communication port is disposed in the front left region and the second communication port is disposed in the rear right region, or alternatively, the first communication port is disposed in the front right region and the second communication port is disposed in the rear left region. The dowel pins configured to position the cylinder body and the cylinder head consist of the first dowel pin fitted into the first communication port and the second dowel pin fitted into the second communication port. As a result, the limited space in the mounting surface of the cylinder body is utilized effectively, and the mounting surface of the cylinder body is prevented from increasing in size. For these reasons, the size of the internal combustion engine as a whole is prevented from increasing, and weight reduction of the internal combustion engine is achieved.

In another preferred embodiment of the present invention, the cylinder body includes at least two of the plurality of cylinders.

The greater the number of the cylinders is, the greater the size of the mounting surface of the cylinder body will be. However, when the first communication port and the second communication port are configured in the manner described above, the mounting surface of the cylinder body is prevented from increasing in size.

In another preferred embodiment of the present invention, the first communication port and the second communication port are located at positions farther away from the first linear line than the bolt insertion holes, in terms of the front-to-rear positional relationship in the cylinder body.

This makes it possible to prevent the size increase of the mounting surface of the cylinder body that is caused by providing the first communication port and the second communication port.

In another preferred embodiment of the present invention, the first communication port is disposed more leftward than the axial center of the leftmost one of the cylinders and the second communication port is disposed more rightward than the axial center of the rightmost one of the cylinders, or the first communication port is disposed more rightward than the axial center of the rightmost one of the cylinders and the second communication port is disposed more leftward than the axial center of the leftmost one of the cylinders.

This allows the positioning of the cylinder body and the engine member to be performed more reliably.

In another preferred embodiment of the present invention, the diameter of the first communication port and the diameter of the second communication port are greater than the diameter of the bolt insertion holes, in the mounting surface of the cylinder body.

This improves the flow of the oil and the like in the first communication port and the second communication port.

In another preferred embodiment of the present invention, the diameter of the first communication port and the diameter of the second communication port are greater than the groove width of the coolant passage, in the mounting surface of the cylinder body.

This improves the flow of the oil and the like in the first communication port and the second communication port.

In another preferred embodiment of the present invention, the first communication port includes a first main communication port having an inner diameter smaller than the outer diameter of the first dowel pin, and a first sub-communication port being in communication with the first main communication port and having an inner diameter greater than the outer diameter of the first dowel pin, and the first dowel pin is fitted into the first sub-communication port and the first passage; and the second communication port includes a second main communication port having an inner diameter smaller than the outer diameter of the second dowel pin, and a second sub-communication port being in communication with the second main communication port and having an inner diameter greater than the outer diameter of the second dowel pin, and the second dowel pin is fitted into the second sub-communication port and the second passage.

In this way, the first dowel pin and the second dowel pin do not fit into the first main communication port and the second main communication port, respectively. Therefore, the first dowel pin and the second dowel pin need not be secured to the first communication port and the second communication port, respectively.

In another preferred embodiment of the present invention, the axial center of the first communication port and the axial center of the first dowel pin are in alignment with each other, and the axial center of the second communication port and the axial center of the second dowel pin are in alignment with each other.

This improves the flow of the oil and the like in the first communication port and the second communication port.

In another preferred embodiment of the present invention, the cylinder body includes an oil supply port disposed more rearward than the first communication port and more frontward than the second communication port.

This simplifies the structure of the oil passage including the oil supply port and improves the flow of the air and the like in the second communication port.

In another preferred embodiment of the present invention, the cylinder body extends frontward and obliquely upward, the cam chain chamber is disposed more rightward than the rightmost one of the plurality of cylinders, and the first communication port is disposed in front of the leftmost one of the plurality of cylinders, and the second communication port is disposed behind the rightmost one of the plurality of cylinders.

As a result, mainly oil flows through the first communication port, while mainly air flows through the second communication port.

In another preferred embodiment of the present invention, the cylinder body extends frontward and obliquely upward, the cam chain chamber is disposed more leftward than the leftmost one of the plurality of cylinders; and the first communication port is disposed in front of the rightmost one of the plurality of cylinders, and the second communication port is disposed behind the leftmost one of the plurality of cylinders.

As a result, mainly oil flows through the first communication port, while mainly air flows through the second communication port.

As described above, various preferred embodiments of the present invention make it possible to provide a motorcycle that achieves efficient layout of the mounting surface of the cylinder body and that prevents the internal combustion engine from increasing in size.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
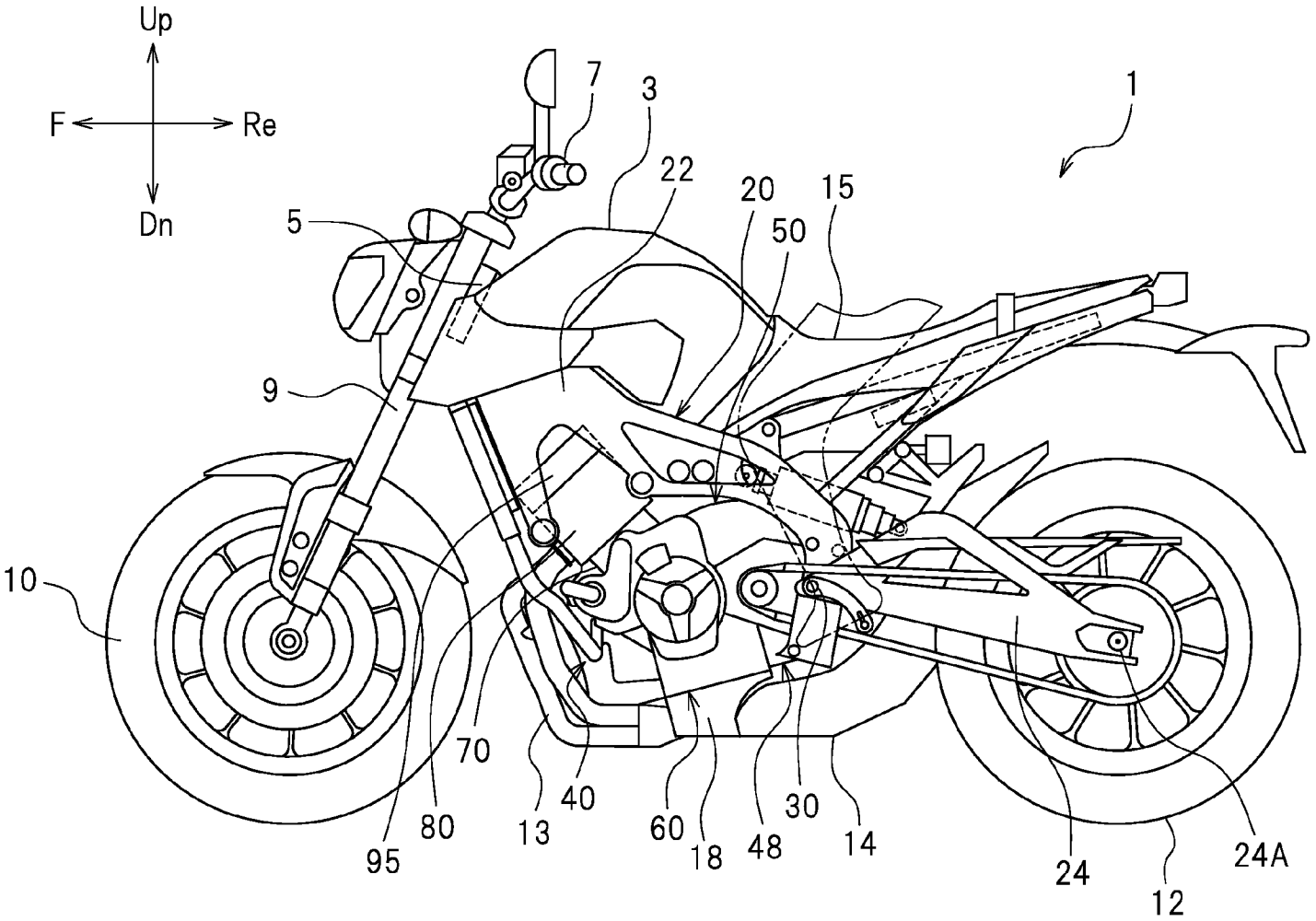
FIG. 1 is a left side view illustrating a motorcycle according to a preferred embodiment of the present invention.

Preferred embodiments of the present invention will be described below with reference to the drawings. As illustrated in FIG. 1, a motorcycle 1 according to a present preferred embodiment preferably is an on-road type motorcycle 1. It should be noted, however, that the motorcycle according to preferred embodiments of the present invention is not limited to the on-road type motorcycle 1. The motorcycle according to preferred embodiments of the present invention may be any other type of motorcycle, such as a moped type motorcycle, an off-road type motorcycle, or a scooter type motorcycle.

In the following description, the terms "front," "rear," "left," "right," "up," and "down" respectively refer to front, rear, left, right, up, and down as defined based on the perspective of the rider seated on the seat 15 of the motorcycle 1, unless specifically indicated otherwise. The terms "above/up" and "below/down" respectively mean the relative vertical positions above/up and below/down as used when the motorcycle 1 is stationary on a horizontal plane. Reference characters F, Re, L, R, Up, and Dn in the drawings indicate front, rear, left, right, up, and down, respectively.

As illustrated in FIG. 1, the motorcycle 1 includes a head pipe 5 and a body frame 20 secured to the head pipe 5. A steering shaft (not shown) is supported on the head pipe 5, and a handlebar 7 is provided on an upper portion of the steering shaft. A front fork 9 is provided on a lower portion of the steering shaft. A front wheel 10 is supported rotatably at the lower end of the front fork 9. A fuel tank 3 is disposed behind the head pipe 5, and a seat 15 is disposed at the rear of the fuel tank 3. The fuel tank 3 and the seat 15 are supported by the body frame 20.

The body frame 20 includes a left main frame 22 extending rearward and obliquely downward from the head pipe 5, and a right main frame 32 (see FIG. 3) extending rearward and obliquely downward from the head pipe 5 and being positioned to the right of the left main frame 22. The body frame 20 includes a left rear arm 24 disposed at the rear of the left main frame 22 and linked to the body frame 20 via a pivot shaft 30, and a right rear arm (not shown) disposed at the rear of the right main frame 32 and linked to the body frame 20 via the pivot shaft 30. A rear wheel 12 is rotatably supported at a rear end portion 24A of the left rear arm 24 and a rear end portion of the right rear arm.

Figure 2:
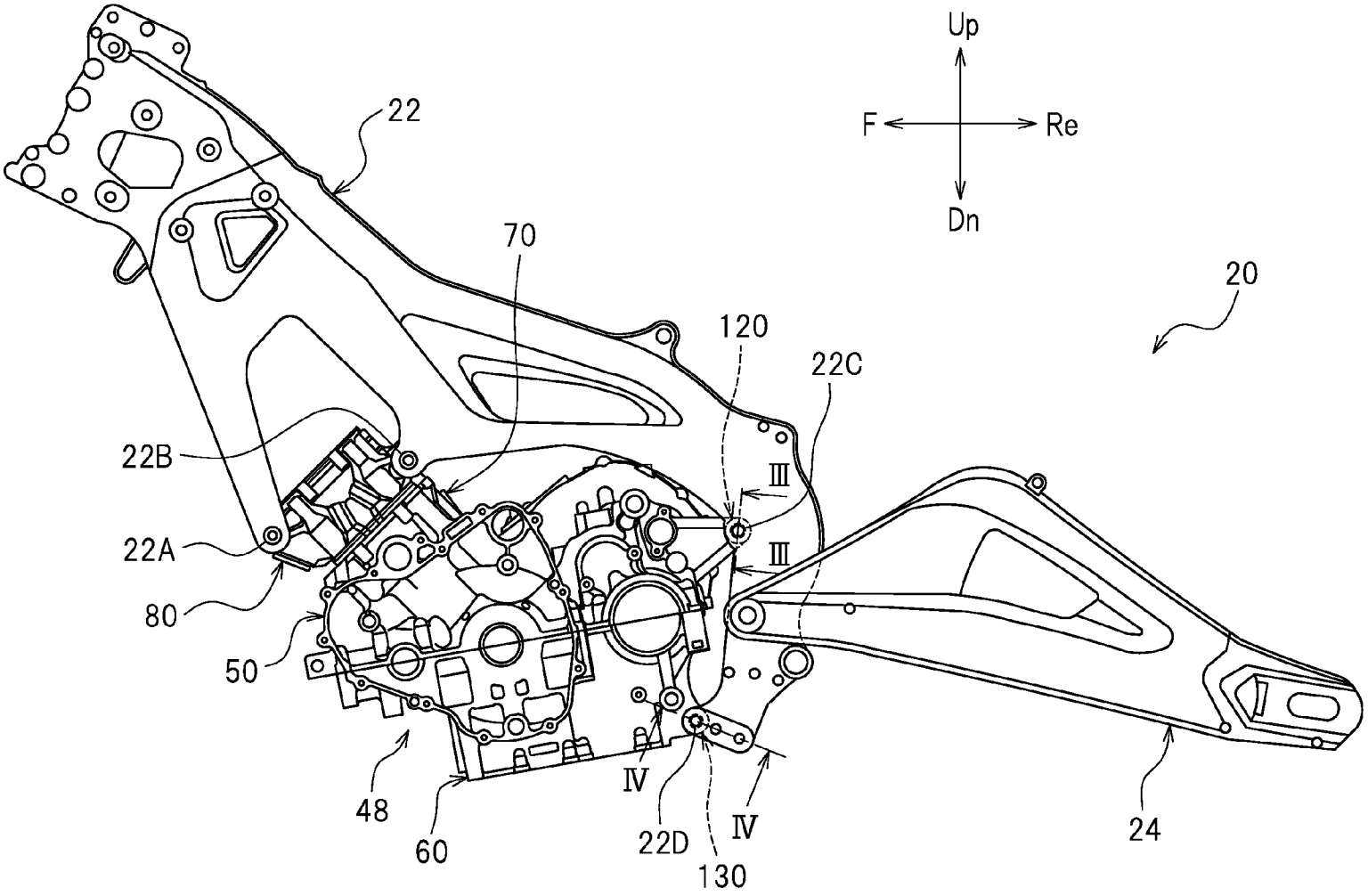
FIG. 2 is a left side view illustrating a left main frame and an internal combustion engine according to a preferred embodiment of the present invention.

The motorcycle 1 includes an internal combustion engine 40. The internal combustion engine 40 is disposed under the left main frame 22 and the right main frame 32. The internal combustion engine 40 is supported non-swingably by the left main frame 22 and the right main frame 32. More specifically, as illustrated in FIG. 2, each of the left main frame 22 and the right main frame 32 includes a first connecting portion 22A, a second connecting portion 22B positioned more rearward than the first connecting portion 22A, a third connecting portion 22C positioned more rearward than the second connecting portion 22B, and a fourth connecting portion 22D positioned lower than the third connecting portion 22C. At the first connecting portion 22A, each of the left main frame 22 and the right main frame 32 is linked to a connecting portion 80A (see FIG. 13) of a later-described cylinder head 80. At the second connecting portion 22B, each of the left main frame 22 and the right main frame 32 is linked to a connecting portion 80B (see FIG. 18) of the cylinder head 80. At the third connecting portion 22C, each of the left main frame 22 and the right main frame 32 is linked to a boss portion 120 (see FIG. 3) of an upper crankcase 50. At the fourth connecting portion 22D, the left main frame 22 and the right main frame 32 are linked to a left boss portion 130 (see FIG. 4) and a right boss portion 134 (see FIG. 4) of a later-described lower crankcase 60.

Figure 5:
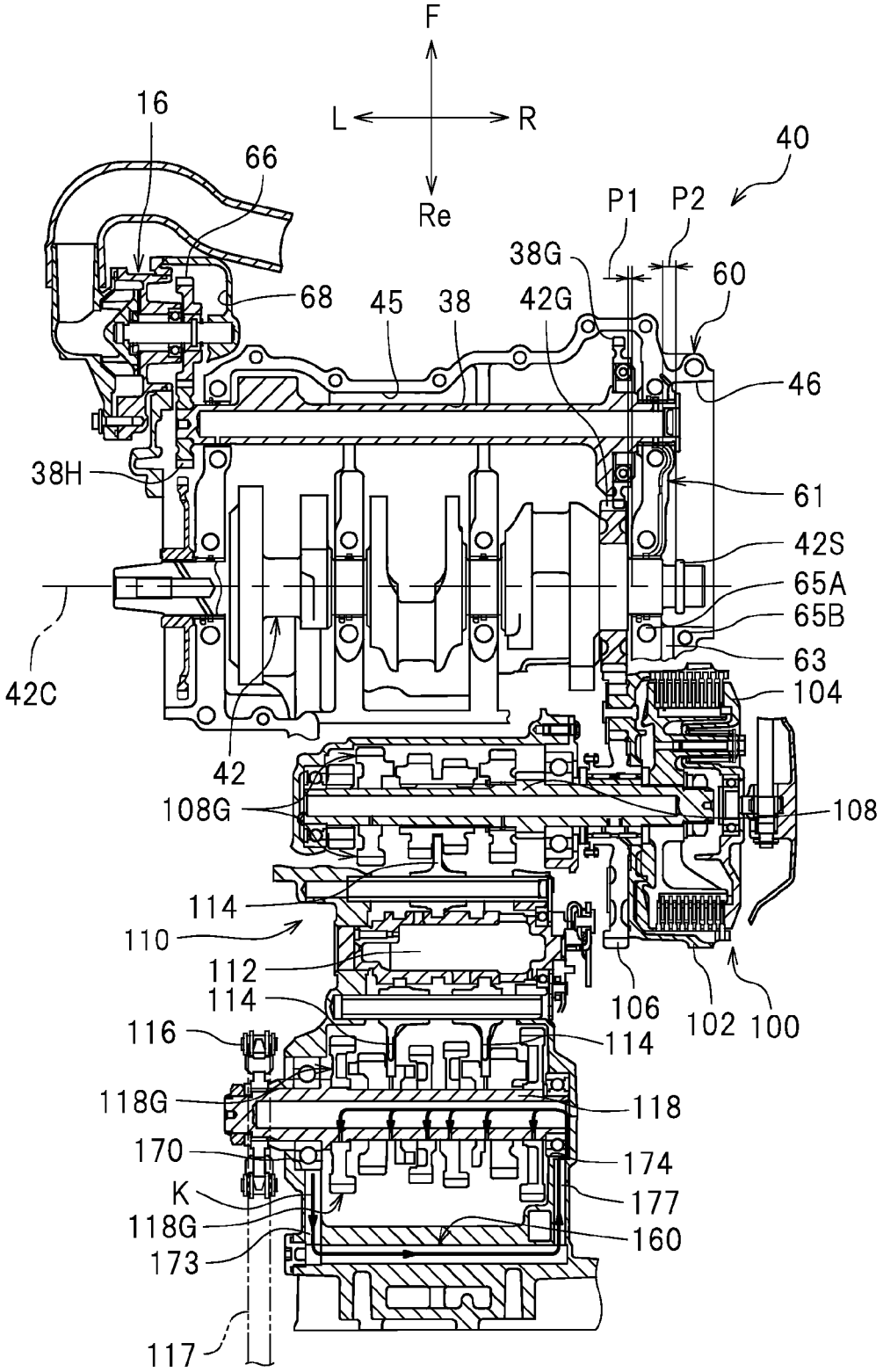
FIG. 5 is a cross-sectional view illustrating an internal combustion engine according to a preferred embodiment of the present invention.
Figure 6:
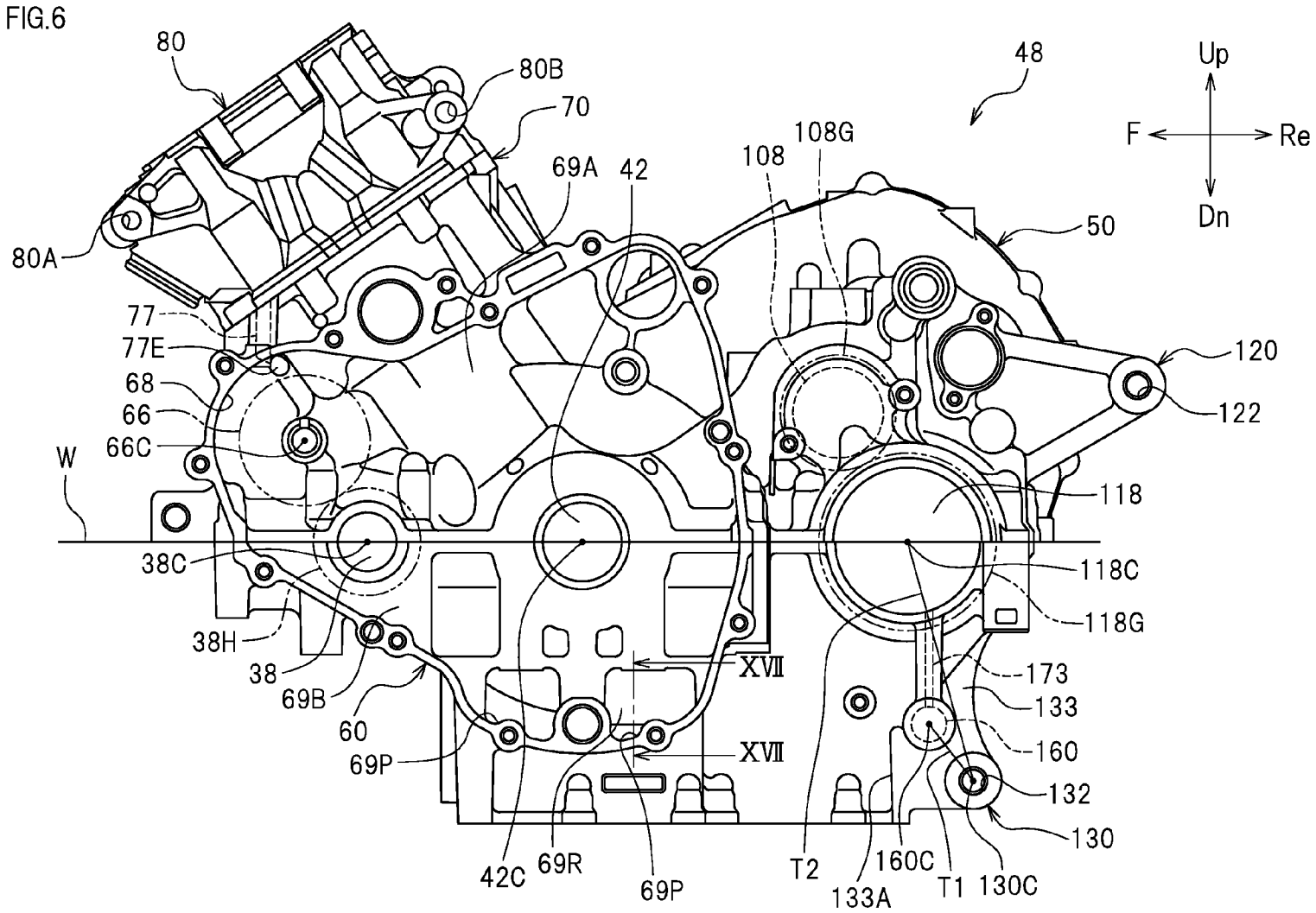
FIG. 6 is a left side view of a crankcase according to a preferred embodiment of the present invention.

As illustrated in FIG. 5, the internal combustion engine 40 preferably is a multi-cylinder engine. The internal combustion engine 40 includes a crankshaft 42 extending in a transverse direction, a balancer shaft 38 positioned more frontward than the crankshaft 42, a main shaft 108 positioned more rearward than the crankshaft 42, a drive shaft 118 positioned more rearward than the main shaft 108, a clutch 100 to which torque of the crankshaft 42 is transmitted, a transmission 110, and a crankcase 48 (see FIG. 1) configured to accommodate these components. The crankcase 48 includes the upper crankcase 50 and the lower crankcase 60. As illustrated in FIG. 6, the upper crankcase 50 is disposed above the crankshaft 42, the balancer shaft 38, and the drive shaft 118. The lower crankcase 60 is disposed below the crankshaft 42, the balancer shaft 38, and the drive shaft 118, and is joined to the upper crankcase 50. The axial center 42C of the crankshaft 42, the axial center 38C of the balancer shaft 38, and the axial center 118C of the drive shaft 118 are disposed on the same linear line W. The main shaft 108 is disposed higher than the balancer shaft 38, the crankshaft 42, and the drive shaft 118. An oil pan 18 (see FIG. 1) configured to recover the oil having been circulated through the inside of the internal combustion engine 40 is disposed below the lower crankcase 60. The lower crankcase 60 and the oil pan 18 are joined to each other. As illustrated in FIG. 5, the crankshaft 42 extends in a transverse direction (in a vehicle width direction). A sprocket 42S is provided at a right end portion of the crankshaft 42. A crank gear 42G is fixed to a portion of the crankshaft 42 that is more leftward than the sprocket 42S.

A gear 38G is fixed to a right end portion of the balancer shaft 38. The gear 38G meshes with a crank gear 42G that is fixed to the crankshaft 42. Thus, the balancer shaft 38 is linked to the crankshaft 42. The balancer shaft 38 is driven by the crankshaft 42.

The clutch 100 includes a clutch housing 102 and a clutch boss 104. The clutch housing 102 is linked to a gear 106. The gear 106 meshes with the crank gear 42G, which is fixed to the crankshaft 42. Thus, the clutch housing 102 of the clutch 100 is linked to the crankshaft 42. The main shaft 108 is fixed to the clutch boss 104. The main shaft 108 is provided with a plurality of gears 108G, and the drive shaft 118 is provided with a plurality of gears 118G. The transmission 110 includes a shift drum 112 and a shift fork 114. The shift fork 114 moves at least either one of the gears 108G or the gears 118G so as to change a combination of the gears 108G and the gears 118G that mesh with each other. As a result, the transmission gear ratio is changed. A sprocket 116 is fitted to a left end portion of the drive shaft 118. The sprocket 116 and the rear wheel 12 (see FIG. 1) are linked to each other by a chain 117. The torque of the crankshaft 42 is transmitted to the rear wheel 12 through the chain 117. The mechanism configured to transmit mechanical power from the drive shaft 118 to the rear wheel 12 is not limited to the chain 117, but may be another type of mechanism, such as a transmission belt, a drive shaft, or a gear mechanism, for example.

Figure 7:
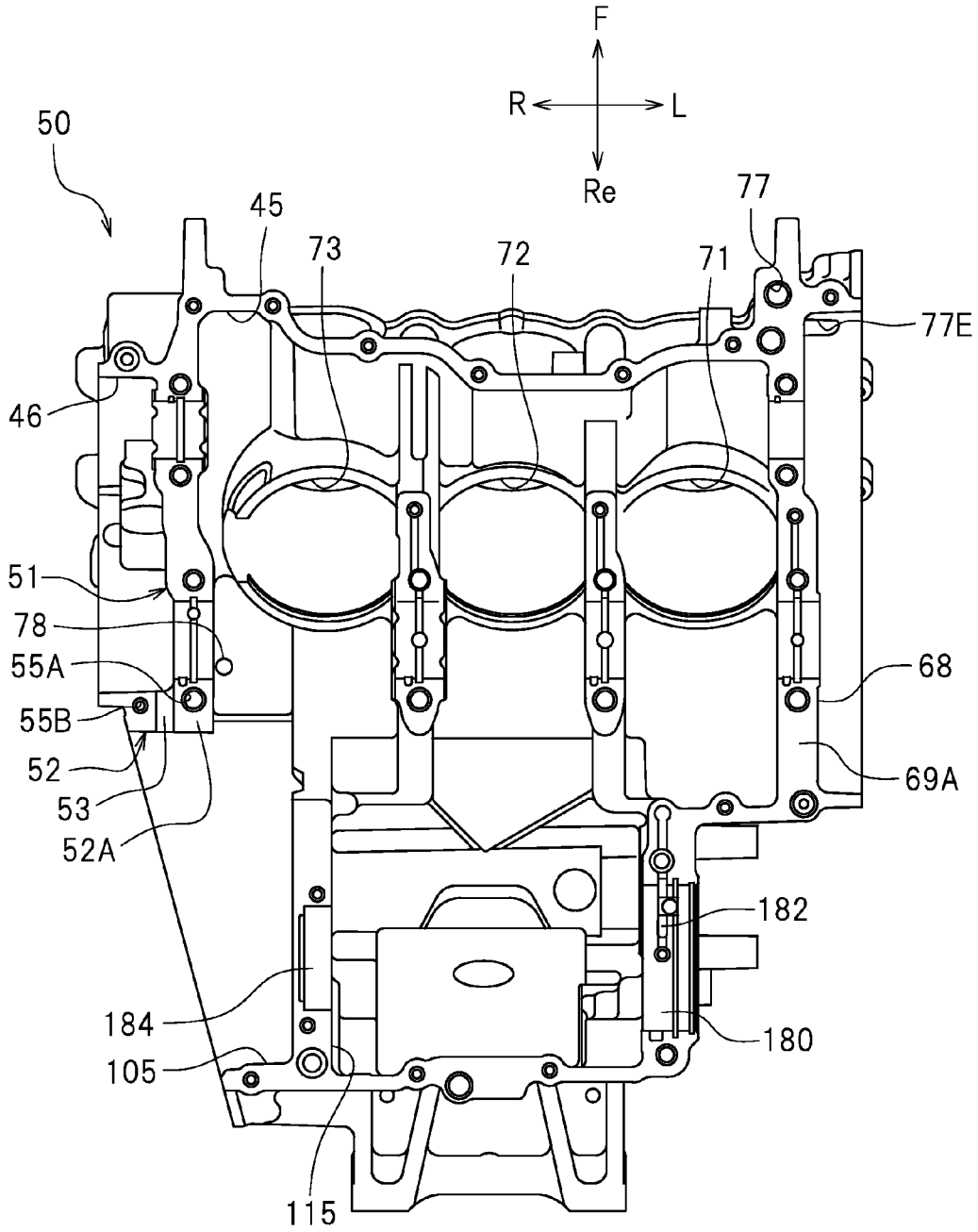
FIG. 7 is a bottom view of an upper crankcase according to a preferred embodiment of the present invention.
Figure 8:
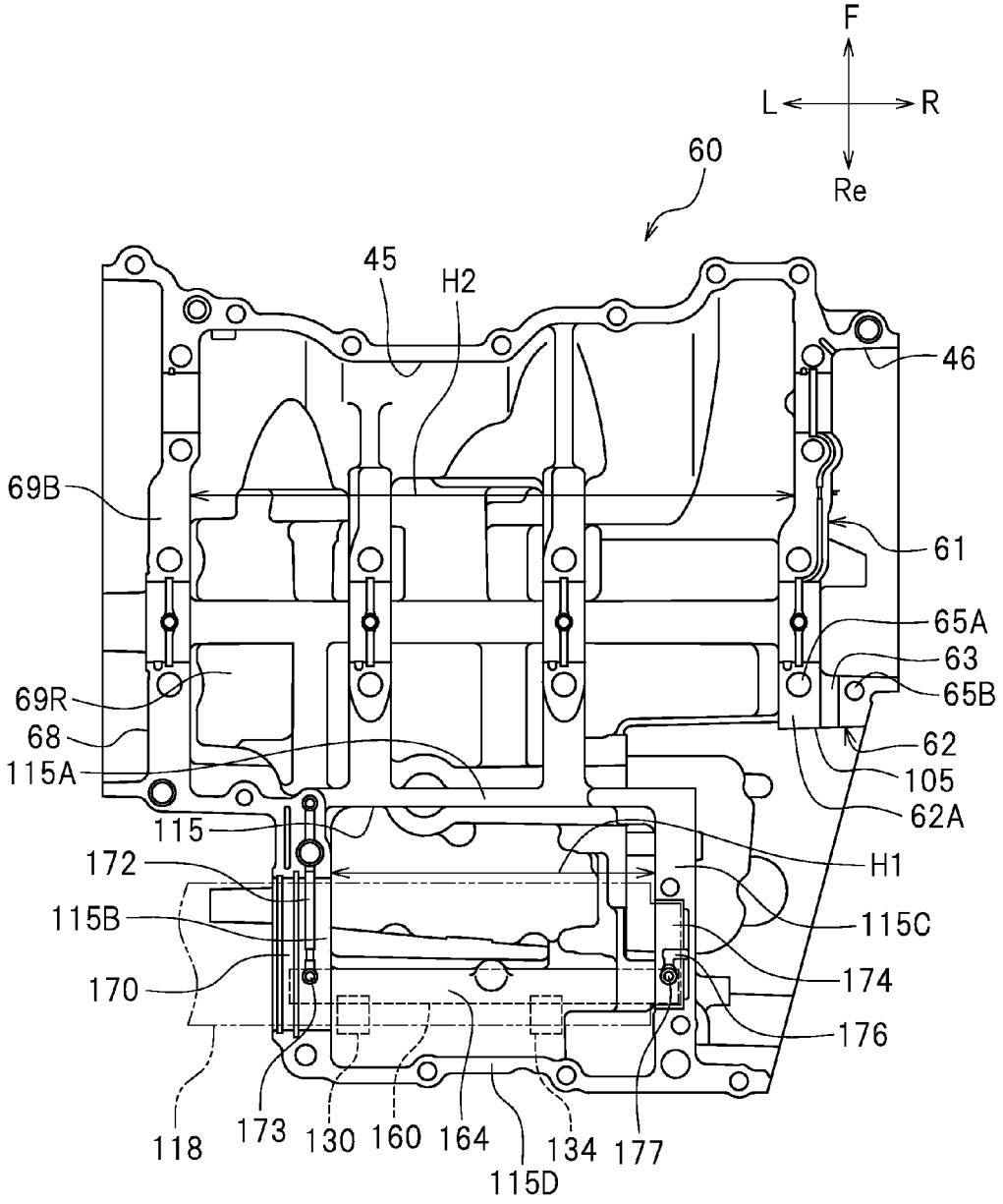
FIG. 8 is a plan view of a lower crankcase according to a preferred embodiment of the present invention.

As illustrated in FIGS. 7 and 8, the upper crankcase 50 and the lower crankcase 60 together define a crank chamber 45 accommodating the crankshaft 42, a clutch chamber 105 accommodating the clutch 100, a transmission chamber 115 accommodating the transmission 110, and a cam chain chamber 46 accommodating a later-described cam chain 47. The upper crankcase 50 and the lower crankcase 60 include the crank chamber 45, the clutch chamber 105, the transmission chamber 115, and the cam chain chamber 46. The transmission chamber 115 accommodates the main shaft 108 and the drive shaft 118. The crank chamber 45 and the clutch chamber 105 are in communication with each other. The crank chamber 45 and the clutch chamber 105 are in communication with each other at the rear of a third cylinder 73. The clutch chamber 105 is positioned to the right of the transmission chamber 115. The left-to-right length H1 of the transmission chamber 115 is shorter than the left-to-right length H2 of the crank chamber 45. The term "left-to-right length" herein means the transverse length. The length H1 represents the length of the transversely longest portion of the transmission chamber 115, and the length H2 represents the length of the transversely longest portion of the crank chamber 45.

As illustrated in FIG. 1, the internal combustion engine 40 includes a cylinder body 70, a cylinder head 80, and a cylinder head cover 95. The cylinder body 70 extends frontward and obliquely upward from the upper crankcase 50. The cylinder head 80 is disposed above the cylinder body 70 and joined to the cylinder body 70. The cylinder head cover 95 is disposed above the cylinder head 80 and joined to an end portion of the cylinder head 80. In the present preferred embodiment, the cylinder body 70 and the upper crankcase 50 preferably are integrally formed with each other so as to be defined by a single monolithic member. However, the cylinder body 70 and the upper crankcase 50 may be formed of separate members, for example. It is possible that a gasket may be disposed between the cylinder head 80 and the cylinder body 70.

Figure 9:
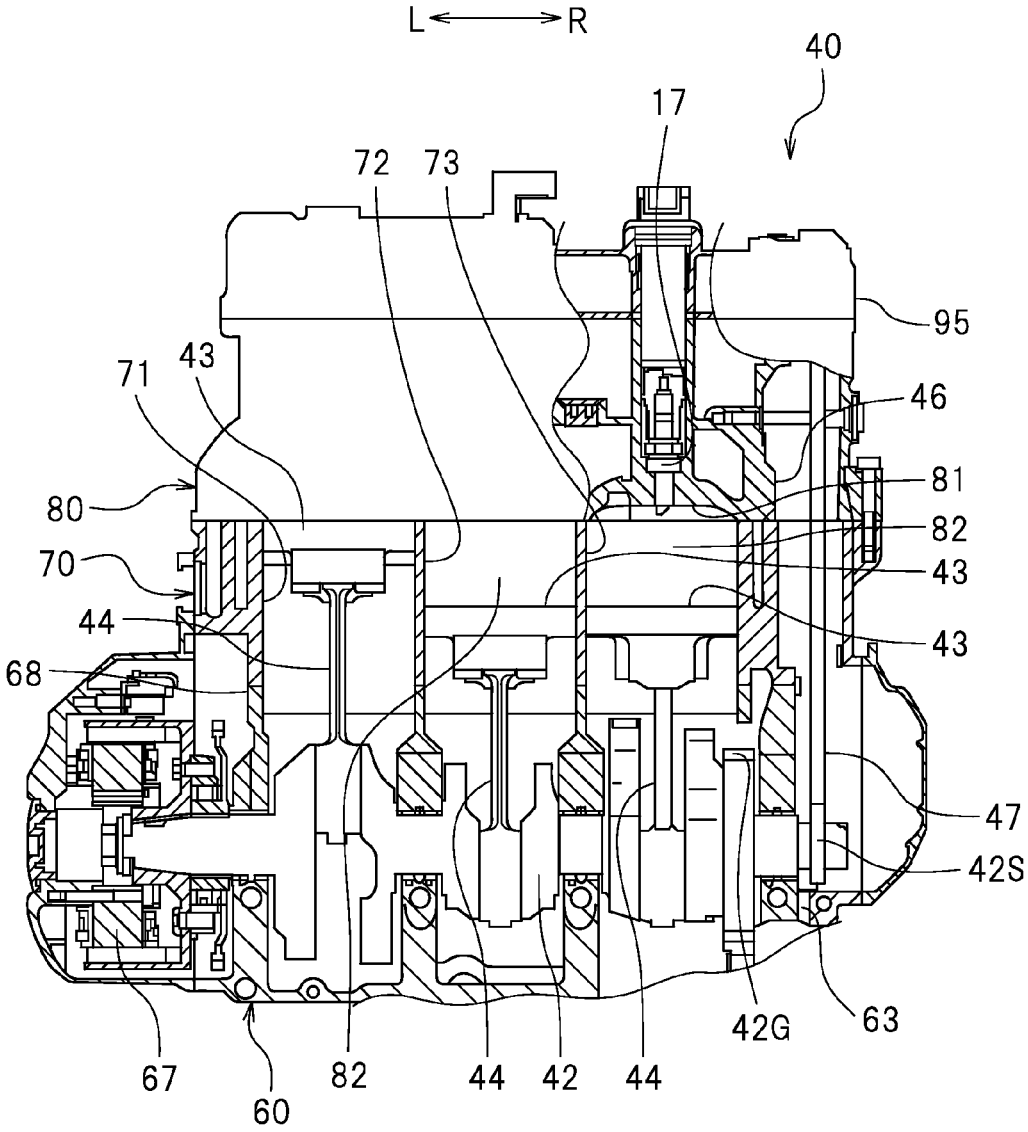
FIG. 9 is a cross-sectional view illustrating a portion of the internal combustion engine according to a preferred embodiment of the present invention.

As illustrated in FIG. 9, a first cylinder 71, a second cylinder 72, and a third cylinder 73 are provided inside the cylinder body 70. The internal combustion engine 40 preferably is a three-cylinder engine, for example. The first cylinder 71, the second cylinder 72, and the third cylinder 73 are disposed from left to right in that order. The first cylinder 71, the second cylinder 72, and the third cylinder 73 accommodate pistons 43. Each of the pistons 43 is connected to the crankshaft 42 via a connecting rod 44. The internal combustion engine 40 of the present preferred embodiment preferably is a three-cylinder engine including three cylinders 71 to 73, for example. However, the internal combustion engine 40 may be a single-cylinder engine including one cylinder, or may be a multi-cylinder engine that includes two cylinders, or four or more cylinders. It is preferable that the internal combustion engine 40 be a multi-cylinder engine including two or more cylinders, for example.

Figure 10:
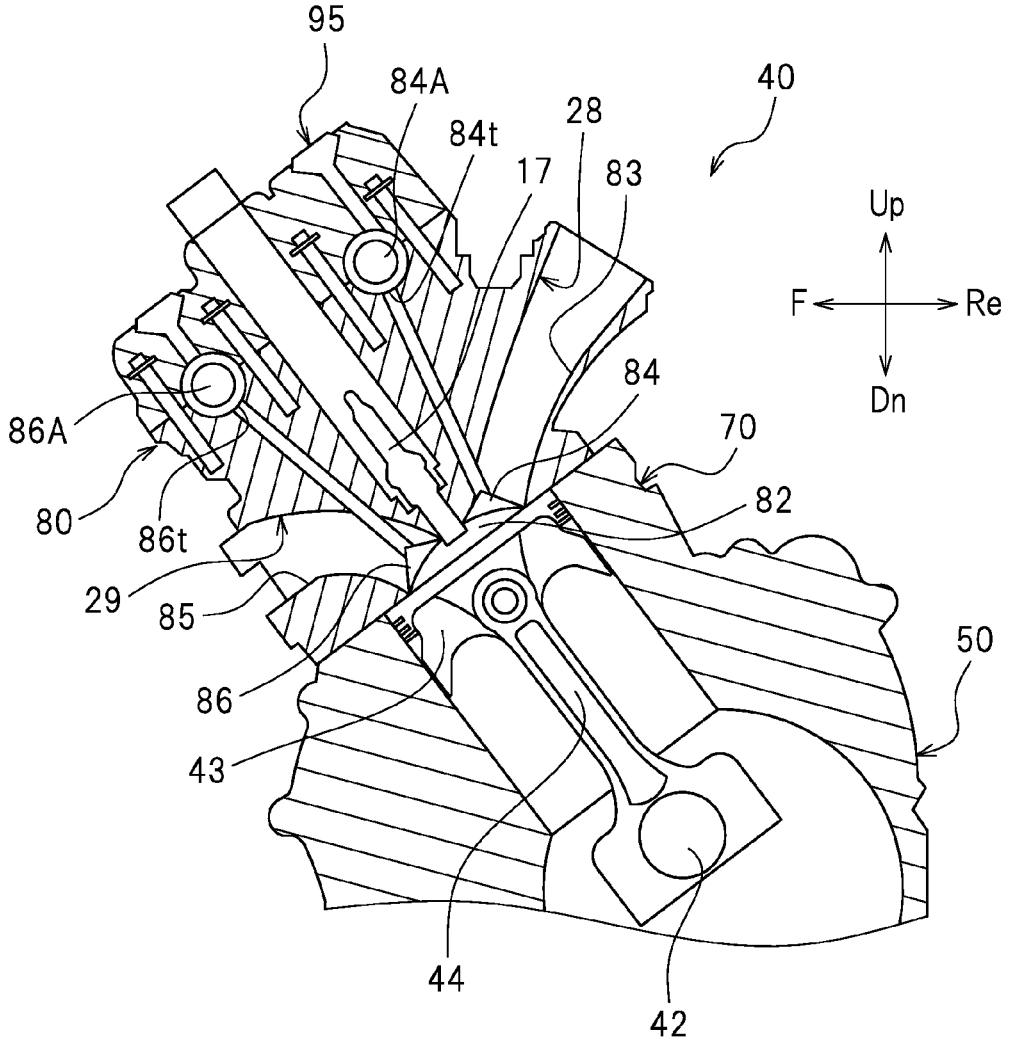
FIG. 10 is a cross-sectional view illustrating a portion of the internal combustion engine according to a preferred embodiment of the present invention.
Figure 11:
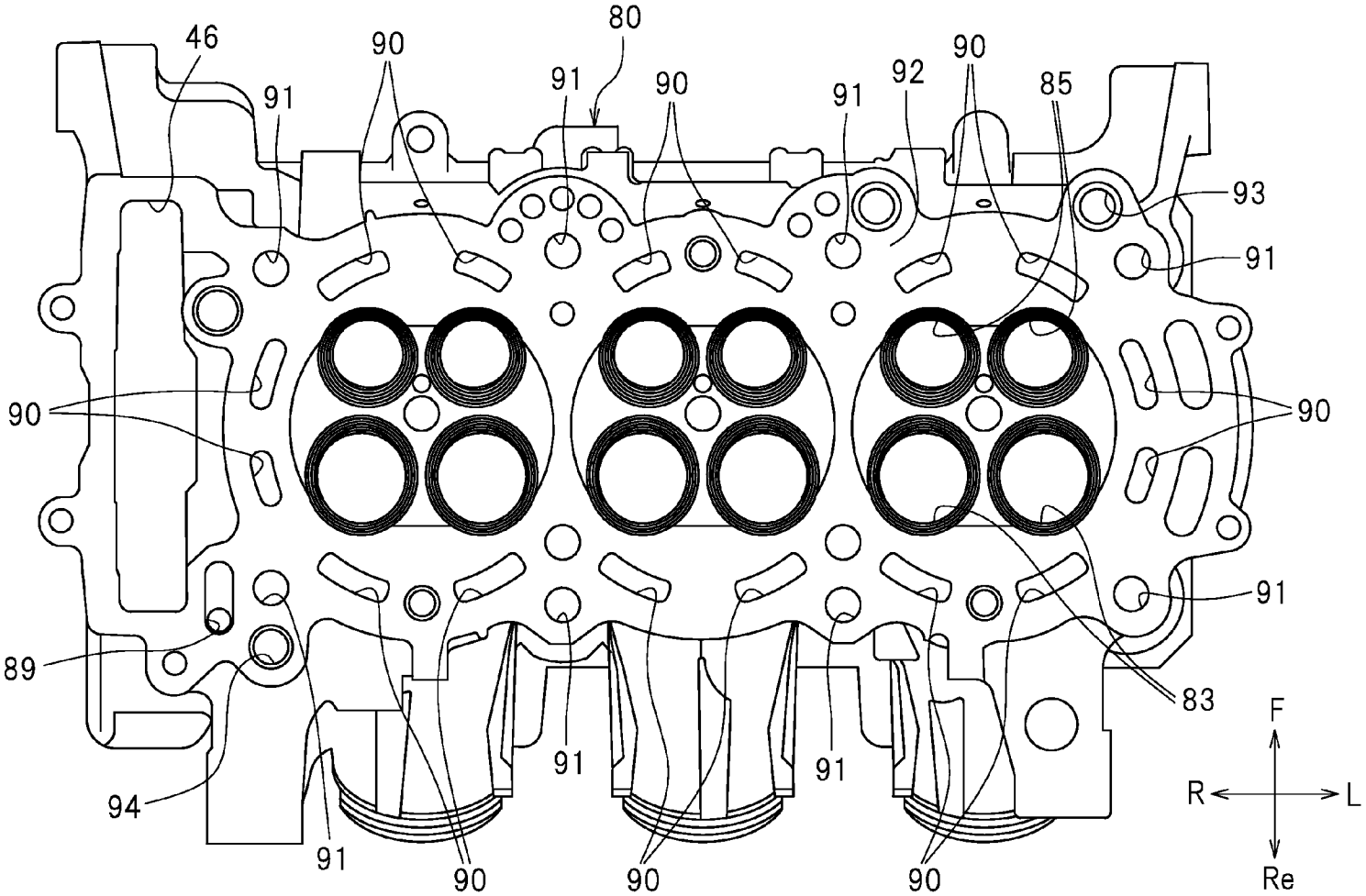
FIG. 11 is a bottom view of a cylinder head according to a preferred embodiment of the present invention.

The internal combustion engine 40 includes three combustion chambers 82 that are lined up in a vehicle width direction. The combustion chamber 82 is defined by the top surface of the piston 43, the inner circumferential wall of each of the cylinders 71 to 73, and a recessed portion 81 located in the cylinder head 80. The combustion chamber 82 is provided with an ignition device 17 (see FIG. 10) configured to ignite the fuel in the combustion chambers 82. As illustrated in FIG. 10, a plurality of intake ports 83 and a plurality of exhaust ports 85, which are in communication with the combustion chambers 82, are provided in the cylinder head 80. The internal combustion engine 40 includes an intake valve 84 configured to open/close the passage between the combustion chamber 82 and the intake port 82, and an exhaust valve 86 configured to open/close the passage between the combustion chamber 82 and the exhaust port 85. The intake port 83 constitutes a portion of an intake passage 28. The intake passage 28 is connected to an air cleaner, which is not shown in the drawings. The exhaust port 85 constitutes a portion of an exhaust passage 29. The exhaust passage 29 includes an exhaust pipe 13 (see FIG. 1), which is fitted to the cylinder head 80, and a silencer 14 (see FIG. 1). As illustrated in FIG. 11, in the present preferred embodiment, each one of the combustion chambers 82 is provided with two intake ports 83 and two exhaust ports 85. The intake valve 84 is disposed for each of the intake ports 83, and the exhaust valve 86 is disposed for each of the exhaust ports 85. It is possible, however, that each one of the combustion chambers 82 may be provided with one intake port 82 and one exhaust port 85. It is also possible that each one of the combustion chambers 82 may be provided with different numbers of intake ports 82 and exhaust ports 85 from each other.

Figure 12:
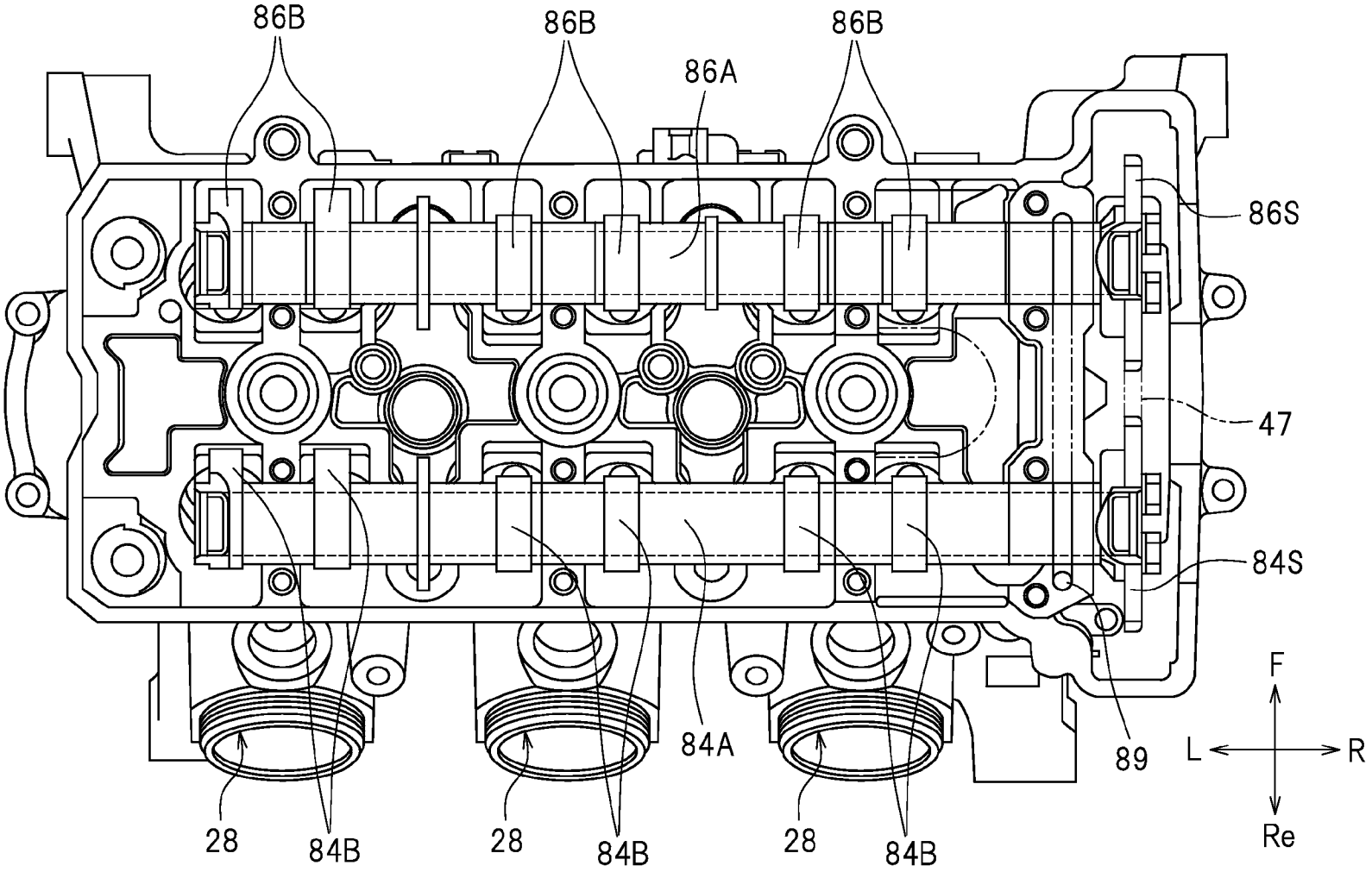
FIG. 12 is a plan view of the cylinder head according to a preferred embodiment of the present invention.
Figure 13:
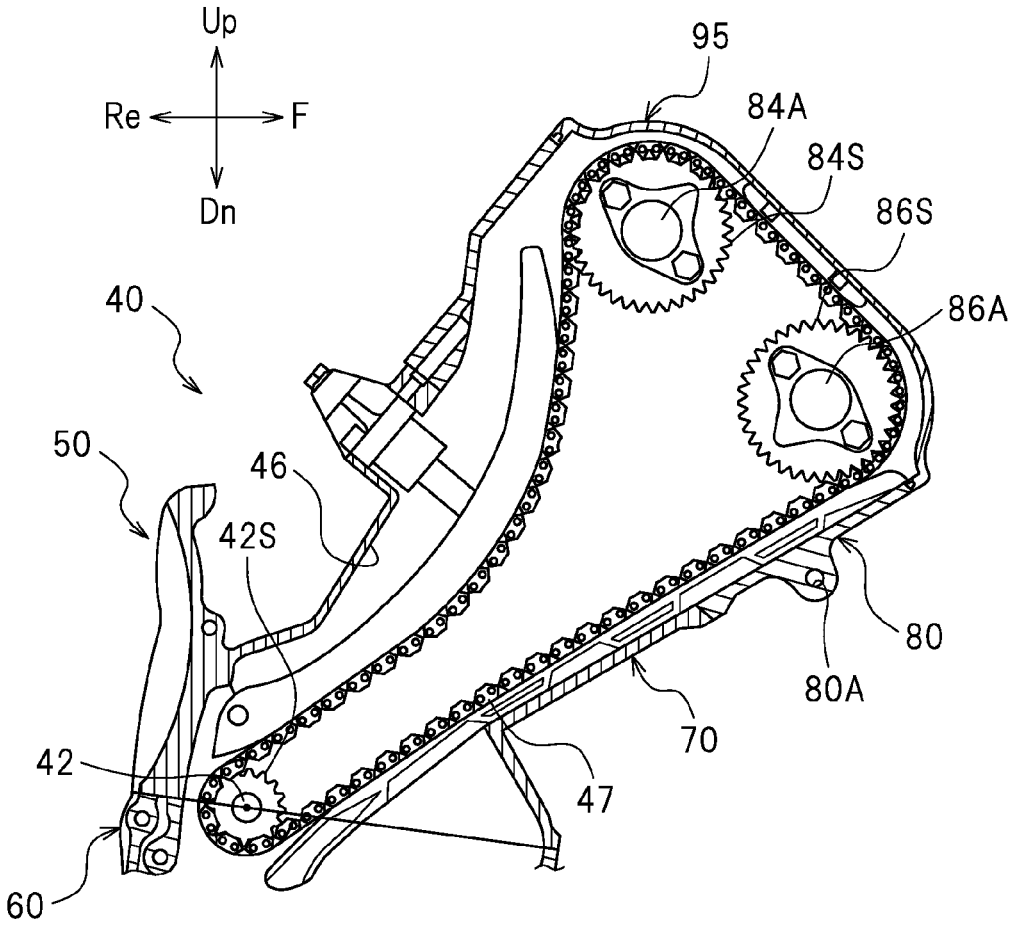
FIG. 13 is a right side view illustrating a cam chain chamber of the internal combustion engine according to a preferred embodiment of the present invention.

As illustrated in FIG. 10, an intake camshaft 84A and an exhaust camshaft 86A extending in a transverse direction are disposed between the cylinder head 80 and the cylinder head cover 95. The intake camshaft 84A includes intake cams 84B (see FIG. 12) each of which comes into contact with an upper end 84*t* of the intake valve 84 to operate the intake valve 84. The exhaust camshaft 85A includes exhaust cams 86B (see FIG. 12) each of which comes into contact with an upper end 86*t* of the exhaust valve 86 to operate the exhaust valve 86. As illustrated in FIG. 12, a cam chain sprocket 84S is fitted to a right end portion of the intake camshaft 84A. A cam chain sprocket 86S is fitted to a right end portion of the exhaust camshaft 86A. As illustrated in FIG. 13, the cam chain 47 is looped over the cam chain sprockets 84S and 86S and the sprocket 42S. The cam chain 47 interlocks with the crankshaft 42.

The internal combustion engine 40 includes the cam chain chamber 46 configured to accommodate the cam chain 47. The cam chain chamber 46 of the present preferred embodiment extends over the entirety of the cylinder head cover 95, the cylinder head 80, the cylinder body 70, the upper crankcase 50, and the lower crankcase 60. As illustrated in FIG. 8, the cam chain chamber 46 is positioned to the right of the crank chamber 45. The clutch chamber 105 is positioned behind the cam chain chamber 46.

Figure 14:
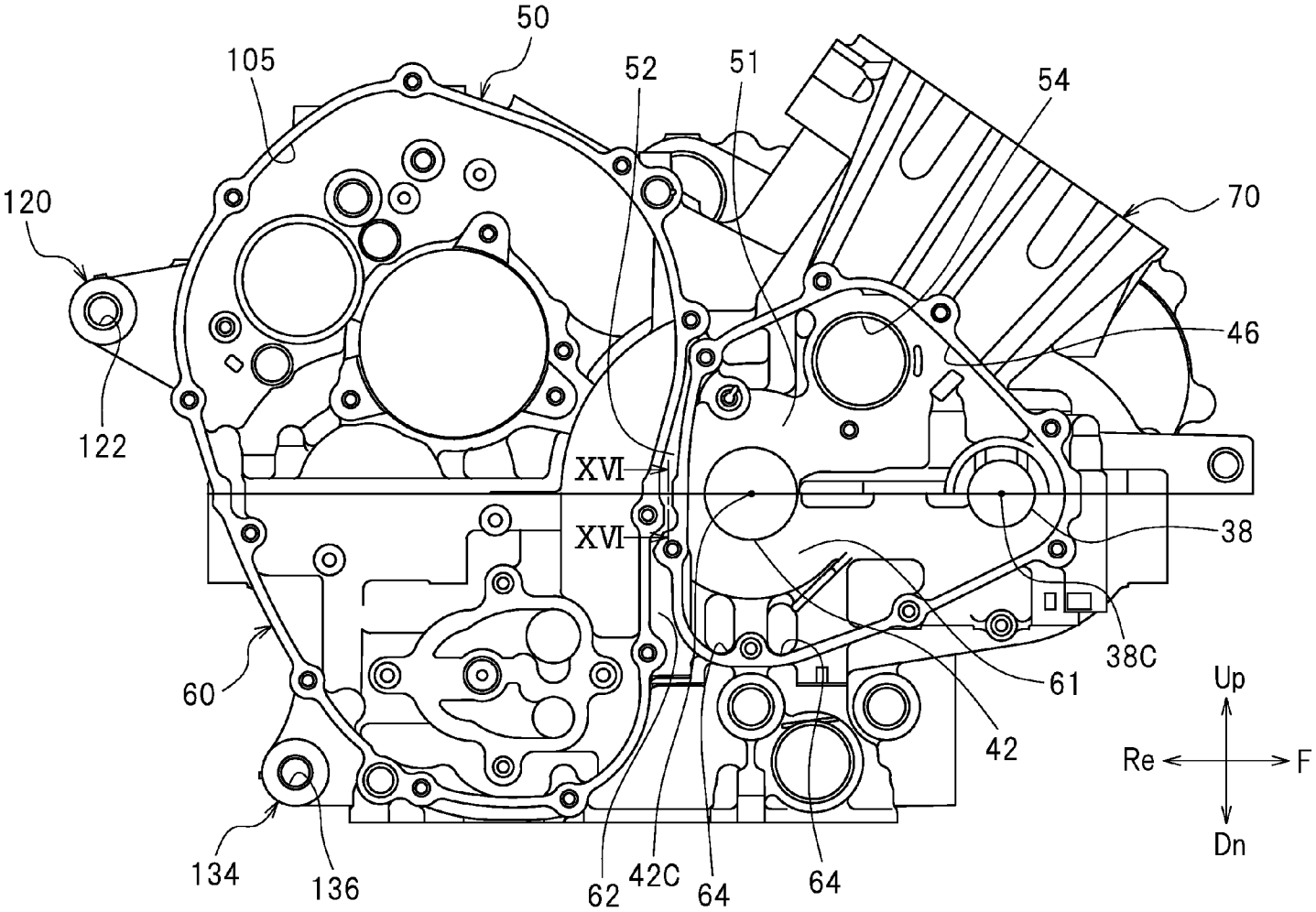
FIG. 14 is a right side view of the crankcase according to a preferred embodiment of the present invention.

As illustrated in FIG. 14, the upper crankcase 50 includes a first upper partition wall 51 and a second upper partition wall 52. As illustrated in FIG. 7, the first upper partition wall 51 separates the cam chain chamber 46 and the crank chamber 45 from each other. The first upper partition wall 52 includes a bottom surface 52A and separates the cam chain chamber 46 and the crank chamber 105 from each other. A first passage 53, including a groove extending in a front-to-rear direction, is provided in the bottom surface 52A of the second upper partition wall 52. The first passage 53 allows communication between the cam chain chamber 46 and the clutch chamber 105. As illustrated in FIG. 14, a second passage 54 configured to allow communication between the cam chain chamber 46 and the crank chamber 45 is provided in the first upper partition wall 51 of the upper crankcase 50. The second passage 54 is positioned below the cylinder body 70. The second passage 54 is positioned more frontward than the axial center 42C of the crankshaft 42. The second passage 54 is positioned more rearward than the axial center 38C of the balancer shaft 38.

The lower crankcase 60 includes a first lower partition wall 61 and a second lower partition wall 62. As illustrated in FIG. 8, the first lower partition wall 61 separates the cam chain chamber 46 and the crank chamber 45 from each other. The first lower partition wall 61 is in contact with the first upper partition wall 51. The second lower partition wall 62 separates the cam chain chamber 46 and the clutch chamber 105 from each other. The second lower partition wall 62 includes a top surface 62A that is in contact with the bottom surface 52A of the second upper partition wall 52. A first passage 63, including a groove extending in a front-to-rear direction, is provided in the top surface 62A of the second lower partition wall 62. The first passage 63 allows communication between the cam chain chamber 46 and the clutch chamber 105. As illustrated in FIG. 14, an oil passage 64 that allows communication between the cam chain chamber 46 and the crank chamber 45 is provided in the first lower partition wall 61. The oil in the cam chain chamber 46 passes through the oil passage 64 and flows into the crank chamber 45, and the oil is recovered in the oil pan 18 positioned below the crank chamber 45. The bottom surface 52A of the second upper partition wall 52 and the top surface 62A of the second lower partition wall 62 may be indirectly in contact with each other, by interposing a gasket or the like between the bottom surface 52A and the top surface 62A.

Figure 15:
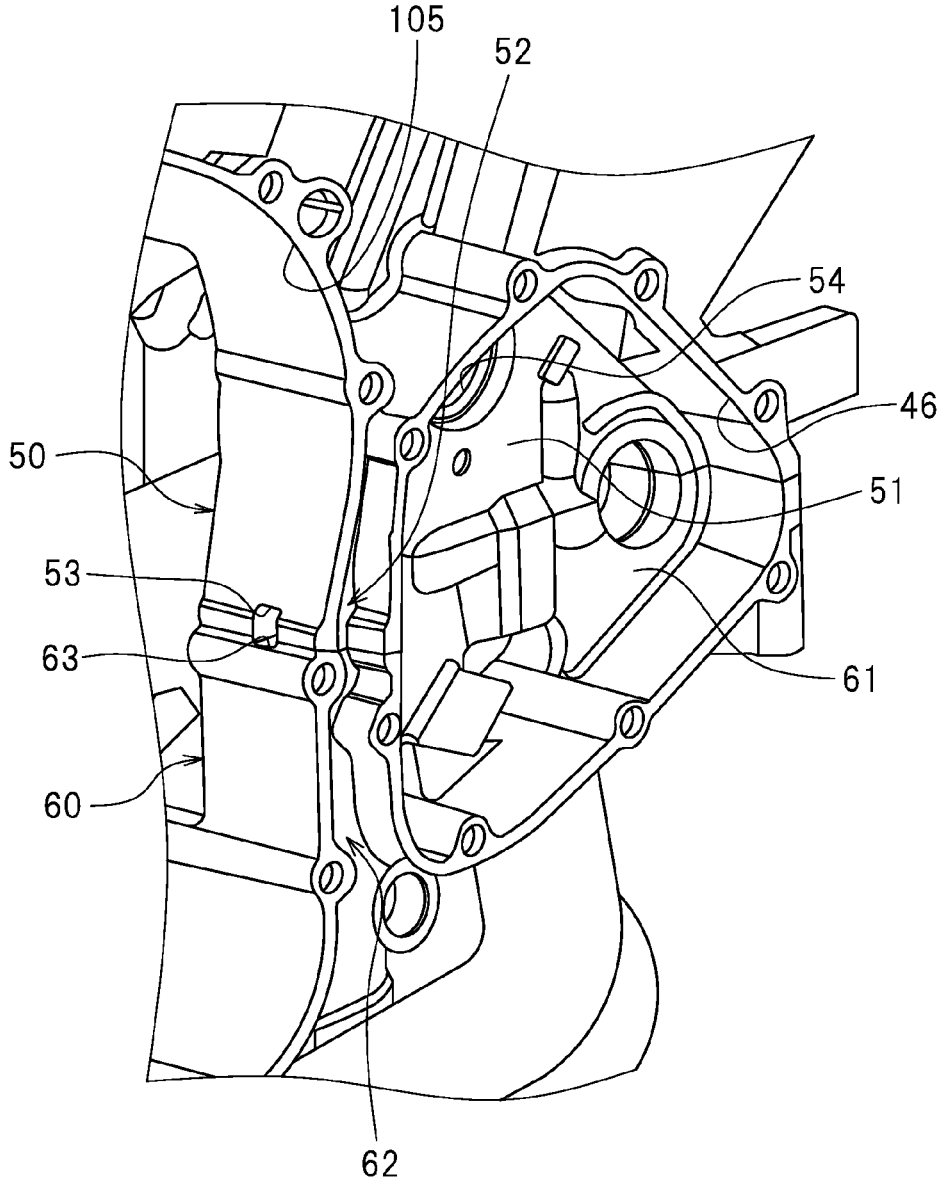
FIG. 15 is a perspective view of the crankcase according to a preferred embodiment of the present invention.
Figure 16:
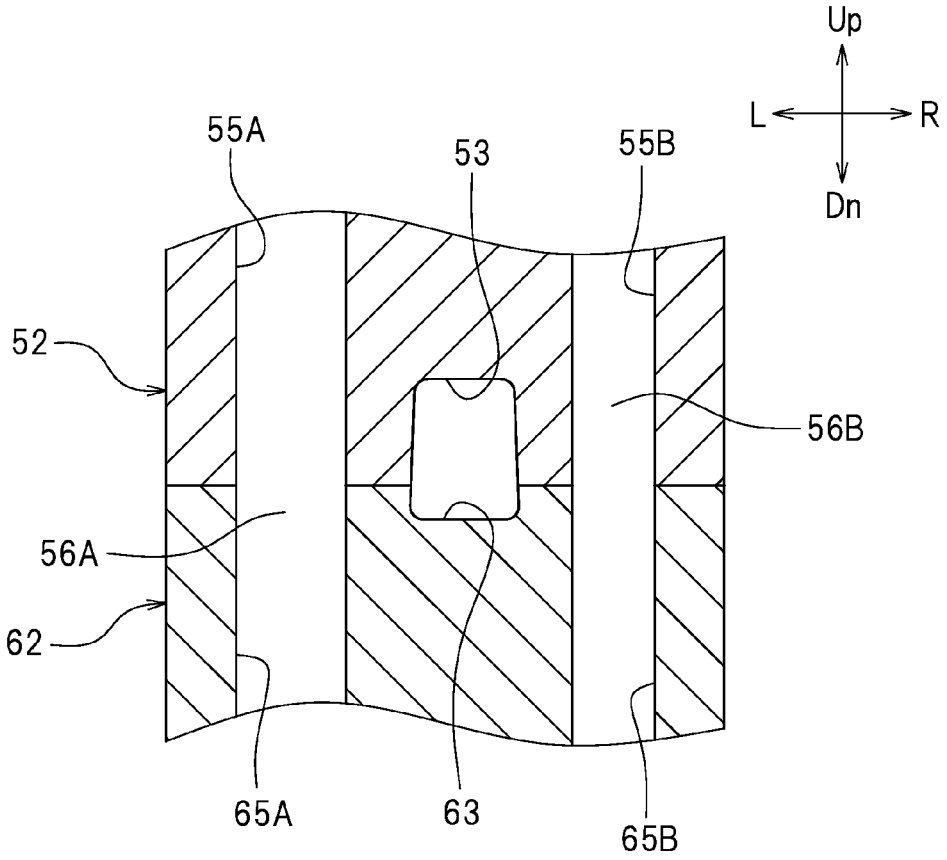
FIG. 16 is a cross-sectional view taken along line XVI-XVI in FIG. 14.

As illustrated in FIG. 15, the first passages 53 and 63 allow communication between the cam chain chamber 46 and the clutch chamber 105. As illustrated in FIG. 16, the vertical length of the first passage 53 is longer than the vertical length of the first passage 63. The left-to-right length of the first passage 53 preferably is the same or substantially the same as the left-to-right length of the first passage 63. The vertical lengths of the first passages 53 and 63 may be equal to each other, or the vertical length of the first passage 63 may be longer than that of the first passage 53. The left-to-right lengths of the first passages 53 and 63 may be different from each other. The first passages 53 and 63 may be disposed so as to be staggered from each other in a transverse direction. In the present preferred embodiment, the first passages 53 and 63 are provided respectively in the bottom surface 52A of the second upper partition wall 52 and the top surface 62A of the second lower partition wall 62. However, it is sufficient that the first passage be provided in at least one of the bottom surface 52A and the top surface 62A. The first passage may be configured to penetrate through at least one of the second upper partition wall 52 and the second lower partition wall 62 so as to allow communication between the cam chain chamber 46 and the clutch chamber 105.

As illustrated in FIG. 7, the upper crankcase 50 includes a first bolt insertion hole 55A and a second bolt insertion hole 55B at the respective opposite sides of the first passage 53. The first bolt insertion hole 55A is positioned more leftward than the second bolt insertion hole 55B. The diameter of the first bolt insertion hole 55A is greater than the diameter of the second bolt insertion hole 55B. As illustrated in FIG. 8, the lower crankcase 60 includes a first bolt insertion hole 65A and a second bolt insertion hole 65B at the respective opposite sides of the first passage 63. The first bolt insertion hole 65A is positioned more leftward than the second bolt insertion hole 65B. The diameter of the first bolt insertion hole 65A is greater than the diameter of the second bolt insertion hole 65B. As illustrated in FIG. 16, the upper crankcase 50 and the lower crankcase 60 are secured to each other preferably by bolts 56A and 56B, for example.

As illustrated in FIG. 5, the sprocket 42S, which is fitted to the right end portion of the crankshaft 42, is accommodated in the cam chain chamber 46. The crank gear 42G of the crankshaft 42 is accommodated in the crank chamber 45. When the crankshaft 42 is rotating, the crank gear 42G and the oil passage 64 may overlap, as viewed from side. A gap P1 between the crank gear 42G and the first lower partition wall 61 is smaller than a gap P2 between the sprocket 42S and the first lower partition wall 61. More specifically, the gaps P1 and P2 are the gap between the first lower partition wall 61 and the crank gear 42G that is at the axial center 42C of the crankshaft 42 and the gap between the first lower partition wall 61 and the sprocket 42S that is at the axial center 42C of the crankshaft 42, respectively.

Figure 17:
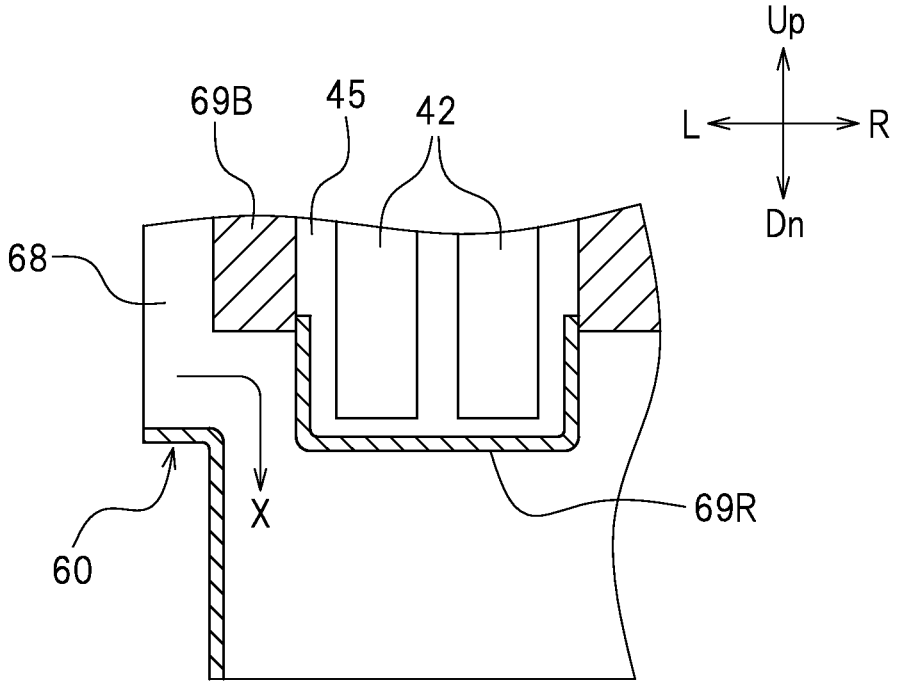
FIG. 17 is a cross-sectional view taken along line XVII-XVII in FIG. 6.

As illustrated in FIG. 9, the internal combustion engine 40 includes an alternator 67. The alternator 67 is fitted to a left end portion of the crankshaft 42. As illustrated in FIG. 6, the upper crankcase 50 and the lower crankcase 60 together define an alternator chamber 68 configured to accommodate the alternator 67. As illustrated in FIG. 5, the alternator chamber 68 is positioned to the left of the crank chamber 45. A plastic gear 66 configured to drive a water pump 16 is disposed in the alternator chamber 68. A gear 38H is fixed to a left end portion of the balancer shaft 38. The gear 38H meshes with the plastic gear 66. Therefore, the water pump 16 interlocks with the balancer shaft 38. As illustrated in FIG. 6, the upper crankcase 50 includes a third upper partition wall 69A. As illustrated in FIG. 7, the third upper partition wall 69A separates the alternator chamber 68 and the crank chamber 45 from each other. The lower crankcase 60 includes a third lower partition wall 69B. As illustrated in FIG. 8, the third lower partition wall 69B separates the alternator chamber 68 and the crank chamber 45 from each other. As illustrated in FIG. 6, the third upper partition wall 69A includes an outlet 77E of a later-described first communication port 77. The outlet 77E is disposed above the plastic gear 66. The outlet 77E is disposed more frontward than the center 66C of the plastic gear 66, as viewed from side. An oil passage 69P that allows communication between the alternator chamber 68 and the crank chamber 45 is located in the third lower partition wall 69B. The oil that has flowed from the cylinder body 70 through the first communication port 77 and the outlet 77E into the alternator chamber 68 is supplied to the plastic gear 66. Thereafter, the oil flows through the oil passage 69P into the crank chamber 45 and is recovered into the oil pan 18, which is positioned below the crank chamber 45. As illustrated in FIG. 17, a rib 69R extending from the third lower partition wall 69B is located below the crankshaft 42. As a result, without being affected by the rotation of the crankshaft 42, the oil in the alternator chamber 68 flows in the direction indicated by the arrow X in FIG. 17 in a desirable manner, and is recovered in the oil pan 18.

Figure 18:
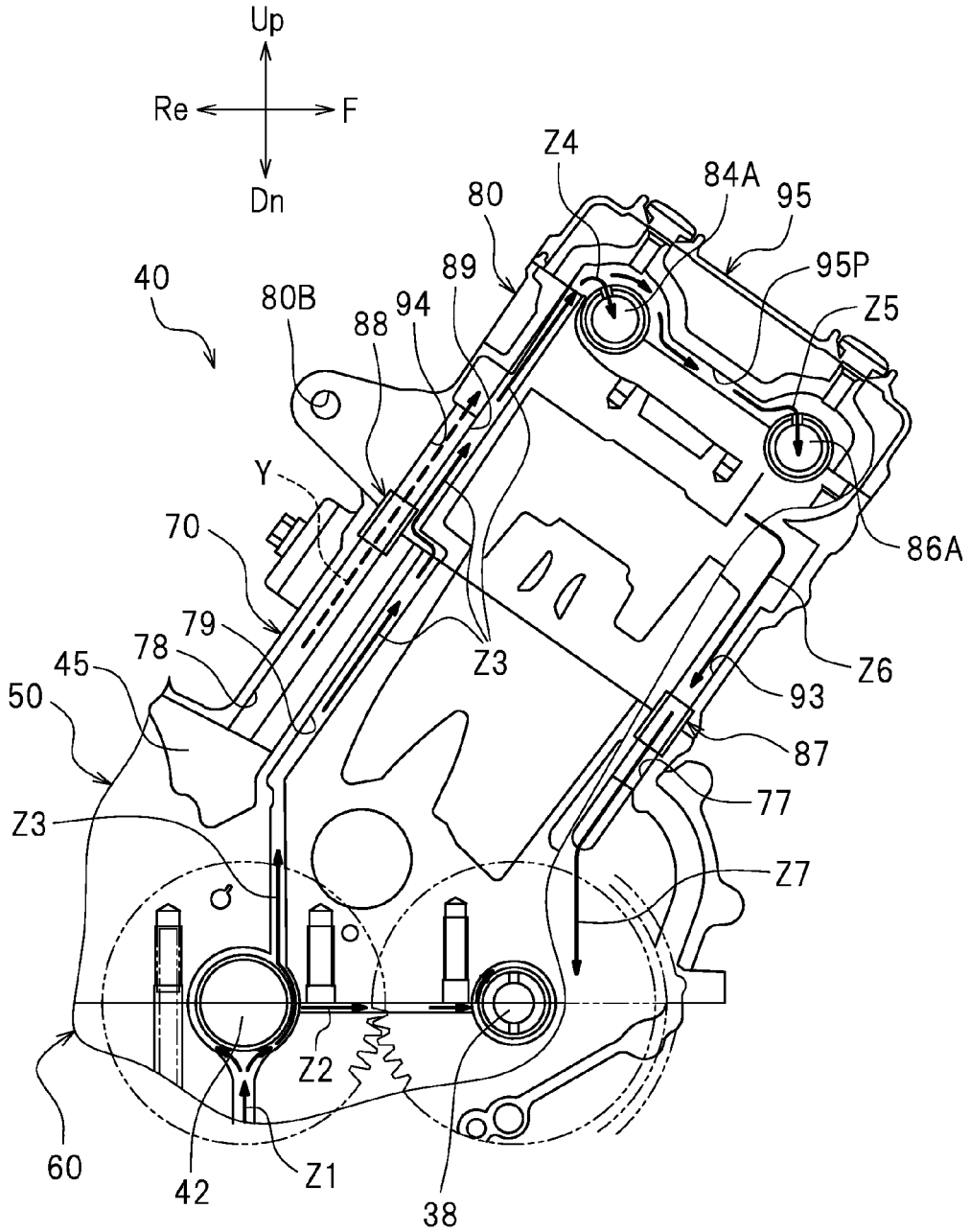
FIG. 18 is a schematic view illustrating a flow of oil in a region surrounding the cylinder head according to a preferred embodiment of the present invention.

As illustrated in FIG. 18, the internal combustion engine 40 includes the cylinder body 70, the cylinder head 80 positioned above the cylinder body 70, and a first cylindrical dowel pin 87 and a second cylindrical dowel pin 88 configured to position the cylinder body 70 and the cylinder head 80. The first dowel pin 87 may be a tapered pin. The second dowel pin 88 may be a tapered pin.

Figure 19:
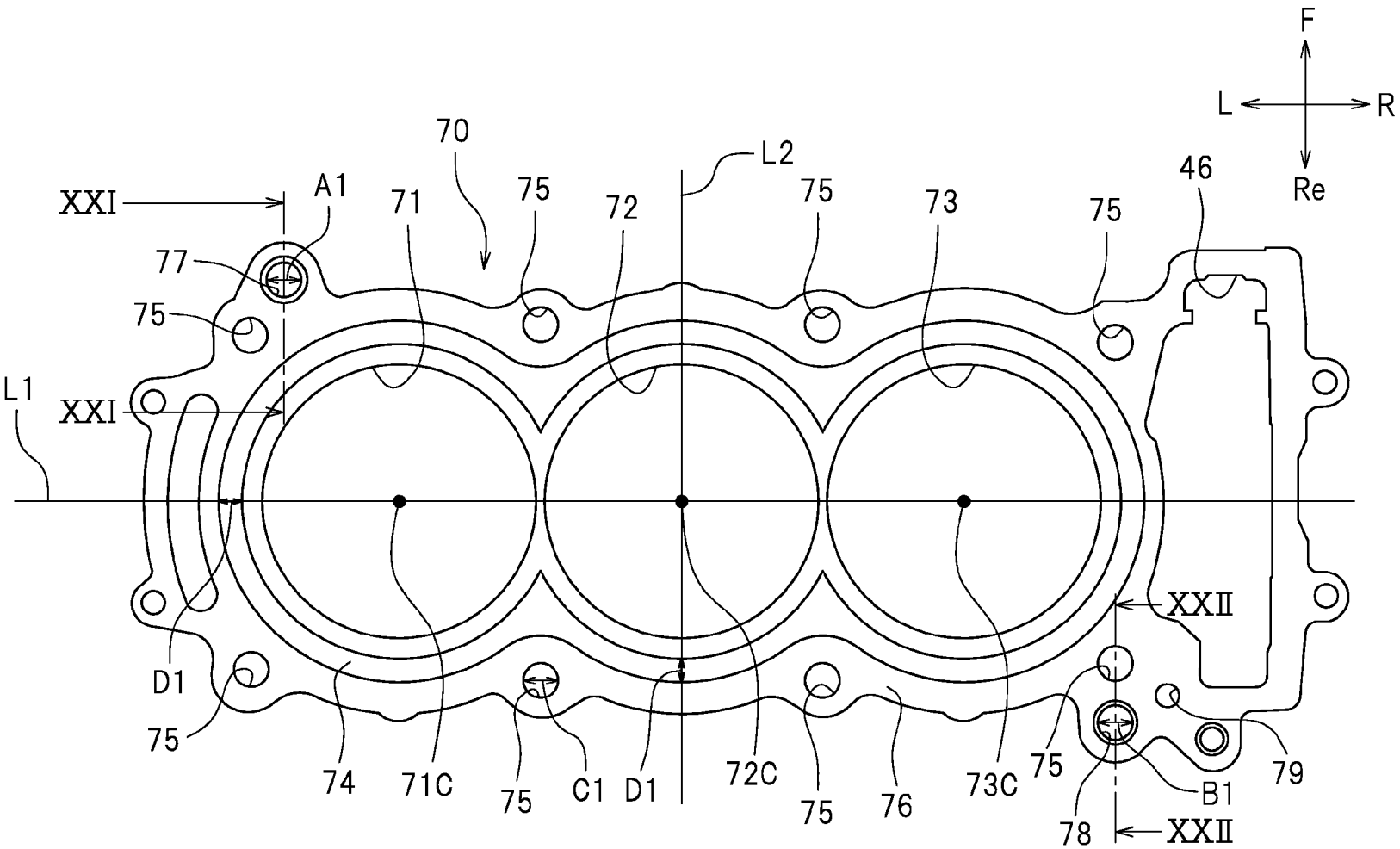
FIG. 19 is a plan view illustrating a mounting surface of a cylinder body according to a preferred embodiment of the present invention.

As illustrated in FIG. 19, the cylinder body 70 includes a mounting surface 76 to be fitted to the cylinder head 80. The cylinder body 70 includes the first cylinder 71, the second cylinder 72, and the third cylinder 73, which are lined up in a transverse direction. The cam chain chamber 46 is disposed to the right of the third cylinder 73, which is the rightmost one of the cylinders. The cylinder body 70 includes a coolant passage 74 that surrounds the cylinders 71 to 73 and through which coolant flows. The cylinder body 70 includes a plurality of bolt insertion holes 75 arranged around the coolant passage 74. The cylinder body 70 includes a first communication port 77 and a second communication port 78. The cylinders 71 to 73, the coolant passage 74, the bolt insertion holes 75, the first communication port 77, and the second communication port 78 are open in the mounting surface 76.

In the mounting surface 76 of the cylinder body 70, a linear line passing through the axial center 71C of the first cylinder 71, the axial center 72C of the second cylinder 72, and the axial center 73C of the third cylinder 73 is defined as a first linear line L1, and a linear line passing through the axial center 72C of the second cylinder 72 and being perpendicular or substantially perpendicular to the first linear line L1 is defined as a second linear line L2. Note that the second linear line L2 preferably passes through the midpoint between the axial center 71C of the first cylinder 71, which is the leftmost one of the cylinders, and the axial center 73C of the third cylinder 73, which is the rightmost one of the cylinders. In the present preferred embodiment, the midpoint is in alignment with the axial center 72C of the second cylinder 72. A region that is in front of the first linear line L1 and to the left of the second linear line L2 is defined as a front left region. A region that is behind the first linear line L1 and to the left of the second linear line L2 is defined as a rear left region. A region that is in front of the first linear line L1 and to the right of the second linear line L2 is defined as a front right region. A region that is behind the first linear line L1 and to the right of the second linear line L2 is defined as a rear right region. Then, the first communication port 77 is disposed in the front left region, and the second communication port 78 is disposed in the rear right region.

Figure 20:
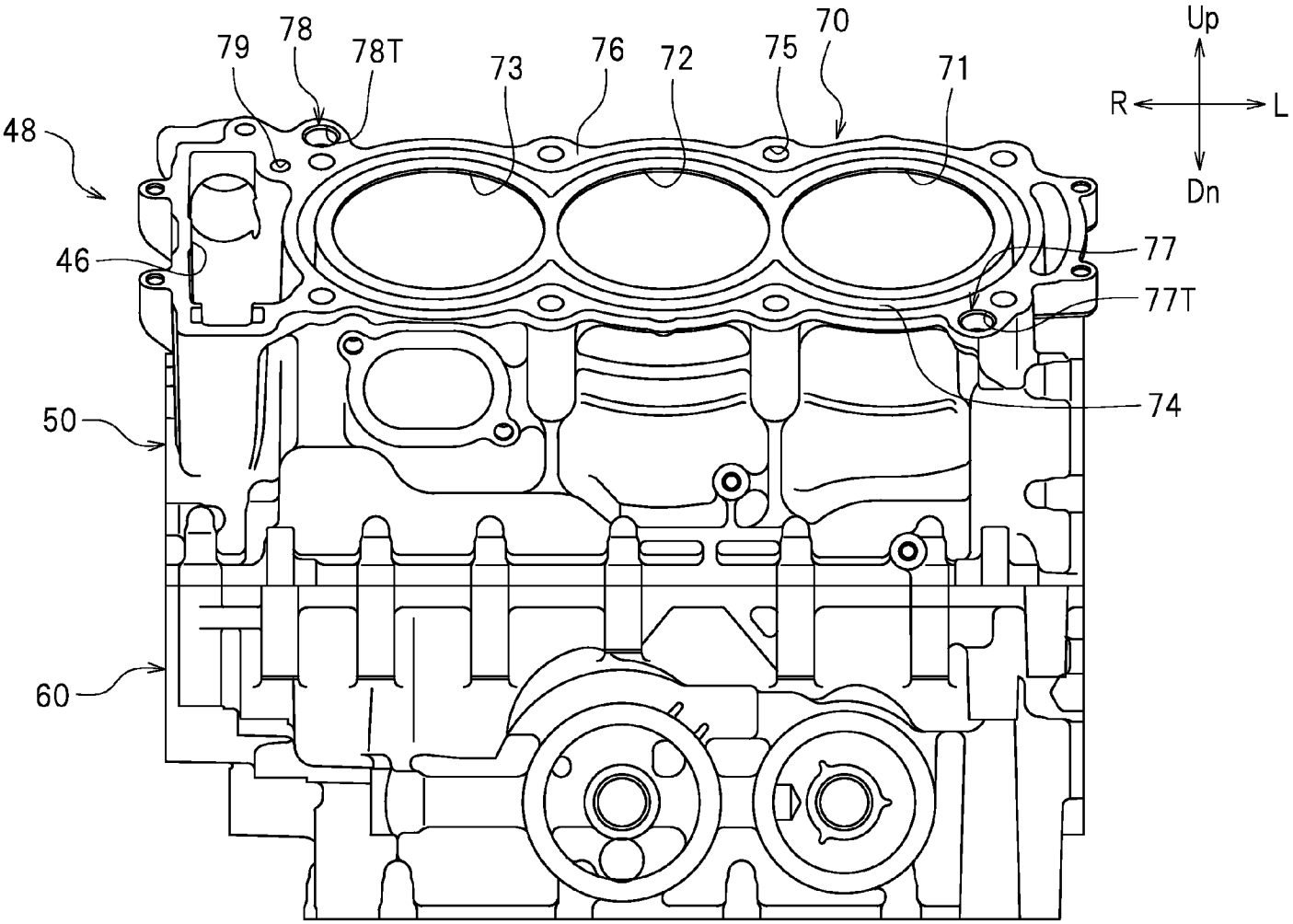
FIG. 20 is a front view of the crankcase according to a preferred embodiment of the present invention.

The first communication port 77 and the second communication port 78 are located at positions farther away from the first linear line L1 than the bolt insertion holes 75, in terms of the front-to-rear positional relationship in the cylinder body 70. The first communication port 77 is positioned more frontward than the bolt insertion holes 75. It is preferable that the first communication port 77 be disposed more leftward than the axial center 71C of the first cylinder 71, which is the leftmost one of the cylinders. It is preferable that the first communication port 77 be disposed in front of the first cylinder 71, which is the leftmost one of the cylinders. The second communication port 78 is positioned more rearward than the bolt insertion holes 75. It is preferable that the second communication port 78 be disposed more rightward than the axial center 73C of the third cylinder 73, which is the rightmost one of the cylinders. It is preferable that the second communication port 78 be disposed behind the third cylinder 73, which is the rightmost one of the cylinders. In the mounting surface 76 of the cylinder body 70, the diameter A1 of the first communication port 77 (the inner diameter A1 of a later-described first main communication port 77A) and the diameter B1 of the second communication port 78 (the inner diameter B1 of a later-described second main communication port 78A) are greater than the diameter C1 of the bolt insertion holes 75. In the mounting surface 76 of the cylinder body 70, the diameter A1 of the first communication port 77 and the diameter B1 of the second communication port 78 are greater than the groove width of the coolant passage 74. The just-mentioned groove width is, for example, the groove width D1 of a portion of the coolant passage 74 that overlaps the first linear line L1 and/or the second linear line L2. As illustrated in FIG. 20, the upper end 77T of the first communication port 77 is disposed lower than the upper end 78T of the second communication port 78. In the present preferred embodiment, the first communication port 77 is disposed more leftward than the axial center 71C of the first cylinder 71. However, because it is sufficient that the first communication port 77 be disposed in the above-described front left region, the first communication port 77 may be disposed, for example, between the axial center 71C of the first cylinder 71 and the axial center 72C of the second cylinder 72. Likewise, in the present preferred embodiment, the second communication port 78 is disposed more rightward than the axial center 73C of the third cylinder 73. However, because it is sufficient that the second communication port 78 be disposed in the above-described rear right region, the second communication port 78 may be disposed, for example, between the axial center 73C of the third cylinder 73 and the axial center 72C of the second cylinder 72. In the case of a multi-cylinder engine including four or more cylinders, it is preferable that at least either one of the first communication port or the second communication port be disposed between cylinders.

Figure 21:
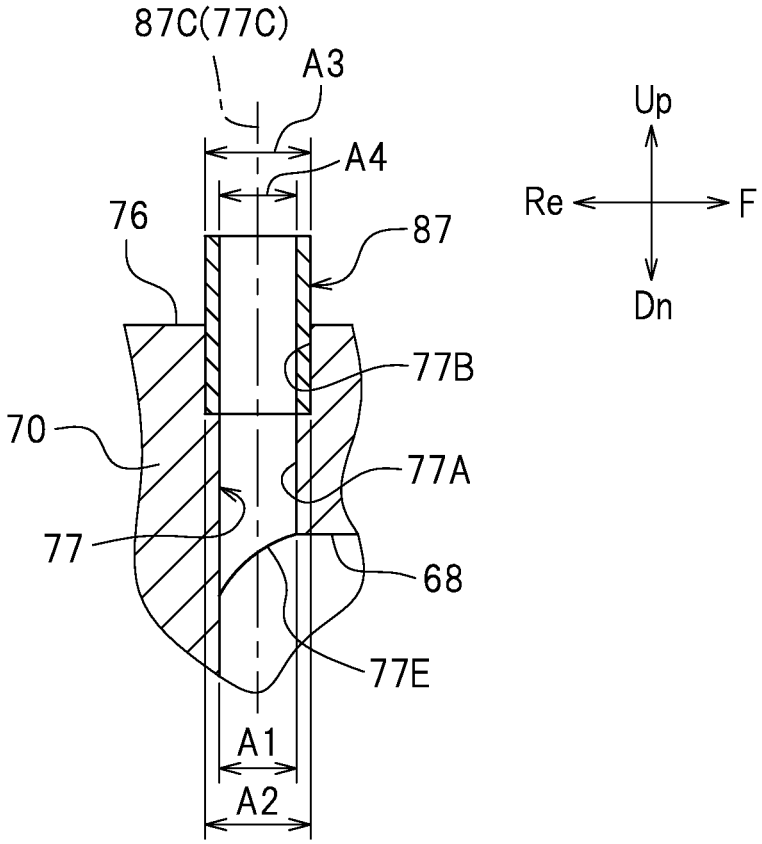
FIG. 21 is a cross-sectional view taken along line XXI-XXI in FIG. 19.

As illustrated in FIG. 21, the first communication port 77 includes a first main communication port 77A and a first sub-communication port 77B, which has the inner diameter A2 greater than the inner diameter A1 of the first main communication port 77A. The first dowel pin 87 is fitted into the first sub-communication port 77B. The outer diameter A3 of the first dowel pin 87 is greater than the inner diameter A1 of the first main communication port 77A. The outer diameter A3 of the first dowel pin 87 is less than or equal to the inner diameter A2 of the first sub-communication port 77B. It is preferable that the axial center 77C of the first communication port 77 and the axial center 87C of the first dowel pin 87 be in agreement with each other. It is preferable that the inner diameter A4 of the first dowel pin 87 is equal or substantially equal to the inner diameter A1 of the first main communication port 77A.

Figure 22:
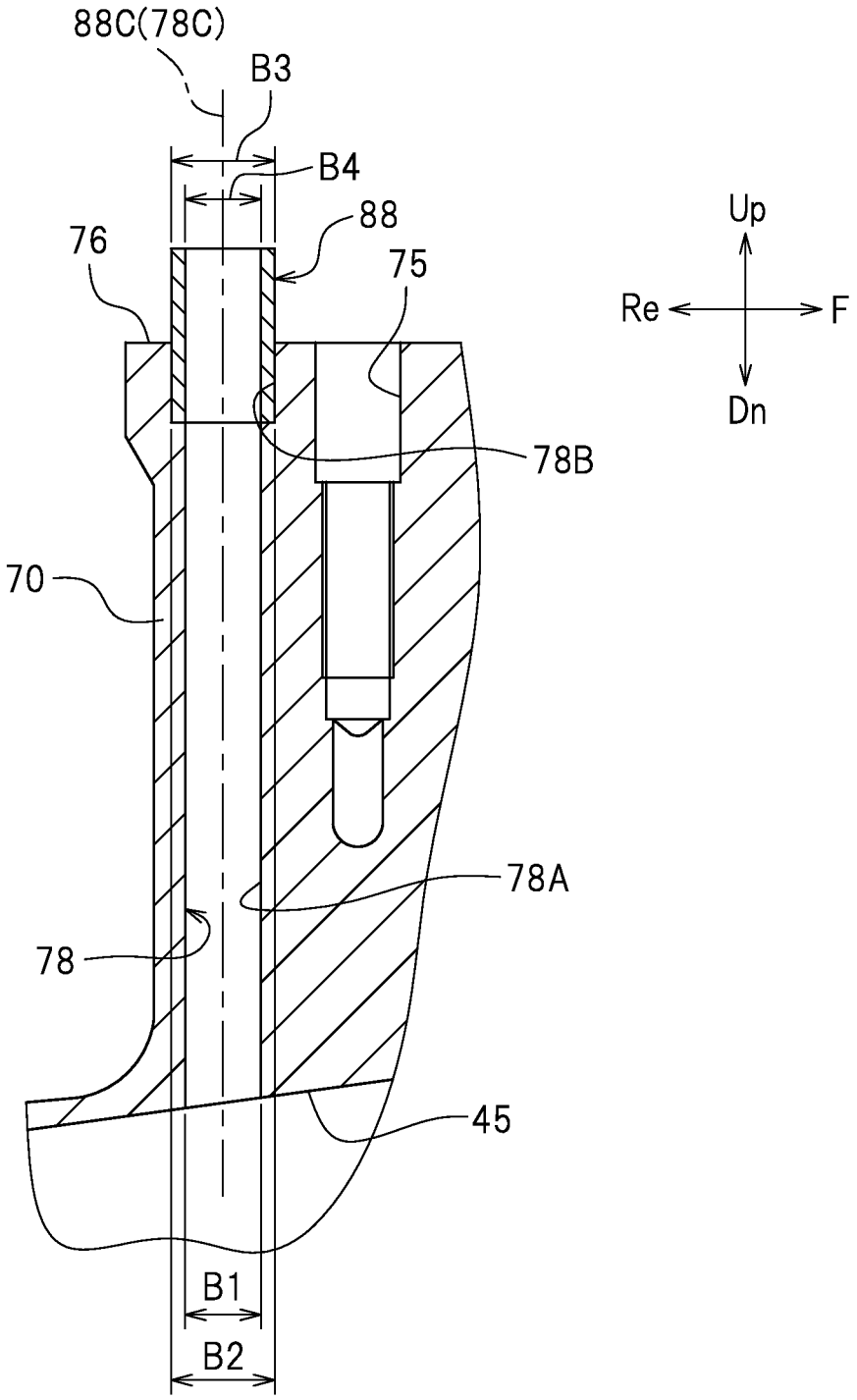
FIG. 22 is a cross-sectional view taken along line XXII-XXII in FIG. 19.

As illustrated in FIG. 22, the second communication port 78 includes a second main communication port 78A and a second sub-communication port 78B, which has the inner diameter B2 greater than the inner diameter B1 of the second main communication port 78A. The second dowel pin 88 is fitted into the second sub-communication port 78B. The outer diameter B3 of the second dowel pin 88 is greater than the inner diameter B1 of the second main communication port 78A. The outer diameter B3 of the second dowel pin 88 is less than or equal to the inner diameter B2 of the second sub-communication port 78B. It is preferable that the axial center 78C of the second communication port 78 and the axial center 88C of the second dowel pin 88 be in agreement with each other. It is preferable that the inner diameter B4 of the second dowel pin 88 be equal to the inner diameter B1 of the second main communication port 78A.

As illustrated in FIG. 19, an oil supply port 79 is provided in the cylinder body 70. The oil in the oil pan 18 is supplied through the oil supply port 79 to the cylinder head 80. The oil supply port 79 is positioned more rearward than the first communication port 77 and more frontward than the second communication port 78. The oil supply port 79 is positioned more rearward than the first linear line L1. The oil supply port 79 is positioned more rightward than the second communication port 78.

As illustrated in FIG. 11, the cylinder head 80 includes a mounting surface 92 to be fitted to the cylinder body 70, a first passage 93, and a second passage 94. The first passage 93 and the second passage 94 are open in the mounting surface 92. The first passage 93 is in communication with the first communication port 77 of the cylinder body 70. The second passage 94 is in communication with the second communication port 78 of the cylinder body 70. At least either oil or air flows through the first passage 93 and the second passage 94. In the present preferred embodiment, mainly oil flows through the first passage 93, and mainly air flows through the second passage 94.

The cylinder head 80 includes a plurality of coolant passages 90 that are in communication with the coolant passage 74 of the cylinder body 70. The cylinder head 80 includes a plurality of bolt insertion holes 91 arranged around the coolant passages 90. The coolant passages 90 and the bolt insertion holes 91 are open in the mounting surface 92. The cylinder head 80 is secured to the cylinder body 70 preferably by bolts (not shown) inserted into the plurality of bolt insertion holes 91. The cam chain chamber 46 is disposed to the right of the second passage 94. An oil supply port 89 is provided in the cylinder head 80. The oil supply port 89 is in communication with the oil supply port 79 of the cylinder body 70. The oil supply port 89 is positioned more rearward than the first passage 93 and more frontward than the second passage 94. The oil supply port 89 is positioned more rearward than the intake port 83. The oil supply port 89 is positioned to the right of the second communication port 94.

As illustrated in FIG. 18, the first dowel pin 87 is fitted into the first communication port 77 and the first passage 93. The first communication port 77 and the first passage 93 are in communication with each other through the first dowel pin 87. The second dowel pin 88 is fitted into the second communication port 78 and the second passage 94. The second communication port 78 and the second passage 94 are in communication with each other through the second dowel pin 88. The first dowel pin 87 disposed lower than the second dowel pin 88. The dowel pins configured to position the cylinder body 70 and the cylinder head 80 are the first dowel pin 87 and the second dowel pin 88 only.

The upper end of the second communication port 78 is open in the mounting surface 76 of the cylinder body 70, and the lower end of the second communication port 78 is open in the crank chamber 45. The second communication port 78 allows communication between the crank chamber 45 and the interior of the cylinder head 80. The air in the crank chamber 45 passes through the second communication port 78, the second dowel pin 88, and the second passage 94 and flows into the cylinder head 80, as indicated by the arrow Y in FIG. 18.

The oil reserved in the oil pan 18 (see FIG. 1) is supplied to the crankshaft 42, as indicated by the arrow Z1 in FIG. 18, by an oil pump, which is not shown in the drawings. A portion of the oil supplied to the crankshaft 42 is supplied to the balancer shaft 38, as indicated by the arrow Z2 in FIG. 18. Another portion of the oil supplied to the crankshaft 42 is supplied to the upper crankcase 50, the oil supply port 79 of the cylinder body 70, and the oil supply port 89 of the cylinder head 80, as indicated by the arrow Z3 in FIG. 18. As indicated by the arrows Z4 and Z5 in FIG. 18, the oil supplied to the oil supply port 89 is then supplied to the intake camshaft 84A and the exhaust camshaft 86A through a cam cap (not shown) and an oil passage 95P. A portion of the oil supplied to the intake camshaft 84A and the exhaust camshaft 86A circulates in the cylinder body 70, and flows into the first passage 93, as indicated by the arrow Z6 in FIG. 18. The oil having flowed into the first passage 93 flows through the first dowel pin 87 and the first communication port 77 and then flows into the alternator chamber 68 (see FIG. 6), as indicated by the arrow Z7 in FIG. 18, and the oil is recovered in the oil pan 18. Another portion of the oil supplied to the intake camshaft 84A and the exhaust camshaft 86A flows into the cam chain chamber 46 (see FIG. 13). The oil in the cam chain chamber 46 passes through the oil passage 64 and flows into the crank chamber 45, and the oil is recovered in the oil pan 18 positioned below the crank chamber 45.

In the present preferred embodiment, the upper crankcase 50 and the cylinder body 70 preferably are integrally formed with each other so as to be defined by a single monolithic member. However, if the upper crankcase and the cylinder body 70 are separate members, the internal combustion engine 40 may include two cylindrical dowel pins between the upper crankcase 50 and the cylinder body 70 to position the upper crankcase 50 and the cylinder body 70. One of the dowel pins is fitted into the first communication port 77, and other one of the dowel pins is fitted into the second communication port 78.

Figure 3:
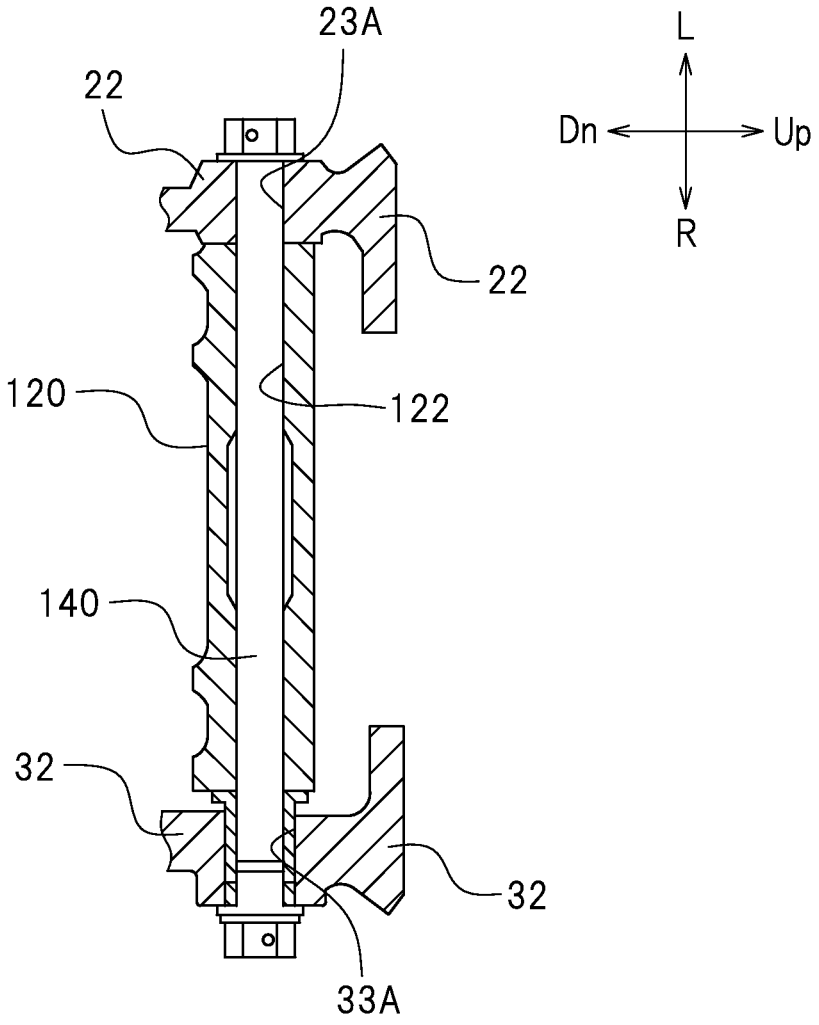
FIG. 3 is a cross-sectional view taken along line III-III in FIG. 2.
Figure 23:
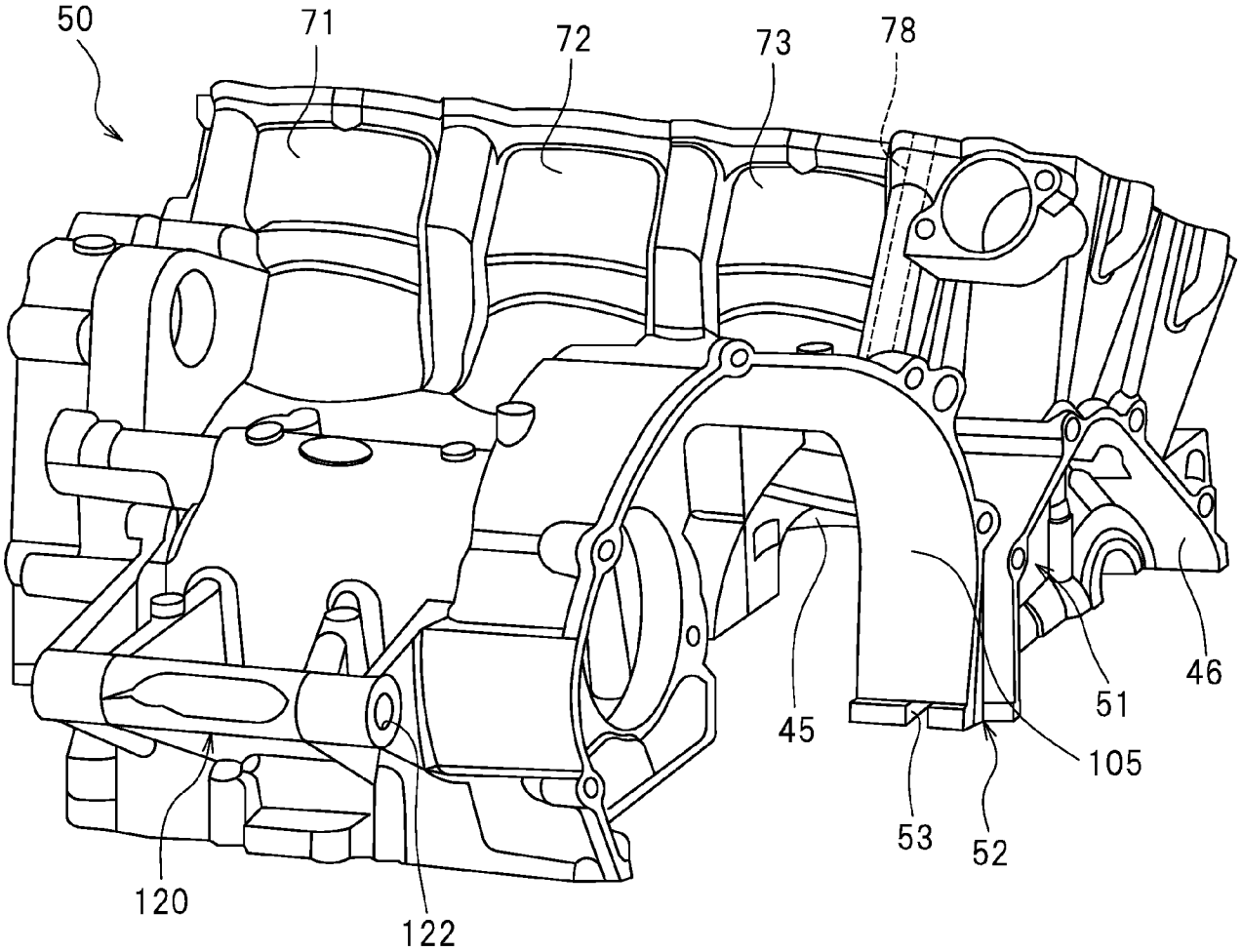
FIG. 23 is a perspective view of the upper crankcase according to a preferred embodiment of the present invention.

As illustrated in FIG. 23, the upper crankcase 50 includes a boss portion 120 extending transversely. The boss portion 120 includes a hole 122 extending in a transverse direction. As illustrated in FIG. 3, the boss portion 120 is disposed between the left main frame 22 and the right main frame 32. A rod-shaped fastener 140 extending in a transverse direction is inserted through a first left insertion hole 23A located in the left main frame 22, a first right insertion hole 33A located in the right main frame 32, and the hole 122 of the boss portion 120. The boss portion 120 of the upper crankcase 50 is secured via the fastener 140 to the left main frame 22 and the right main frame 32. As illustrated in FIG. 14, the boss 120 is disposed more rearward than the clutch chamber 105.

Figure 4:
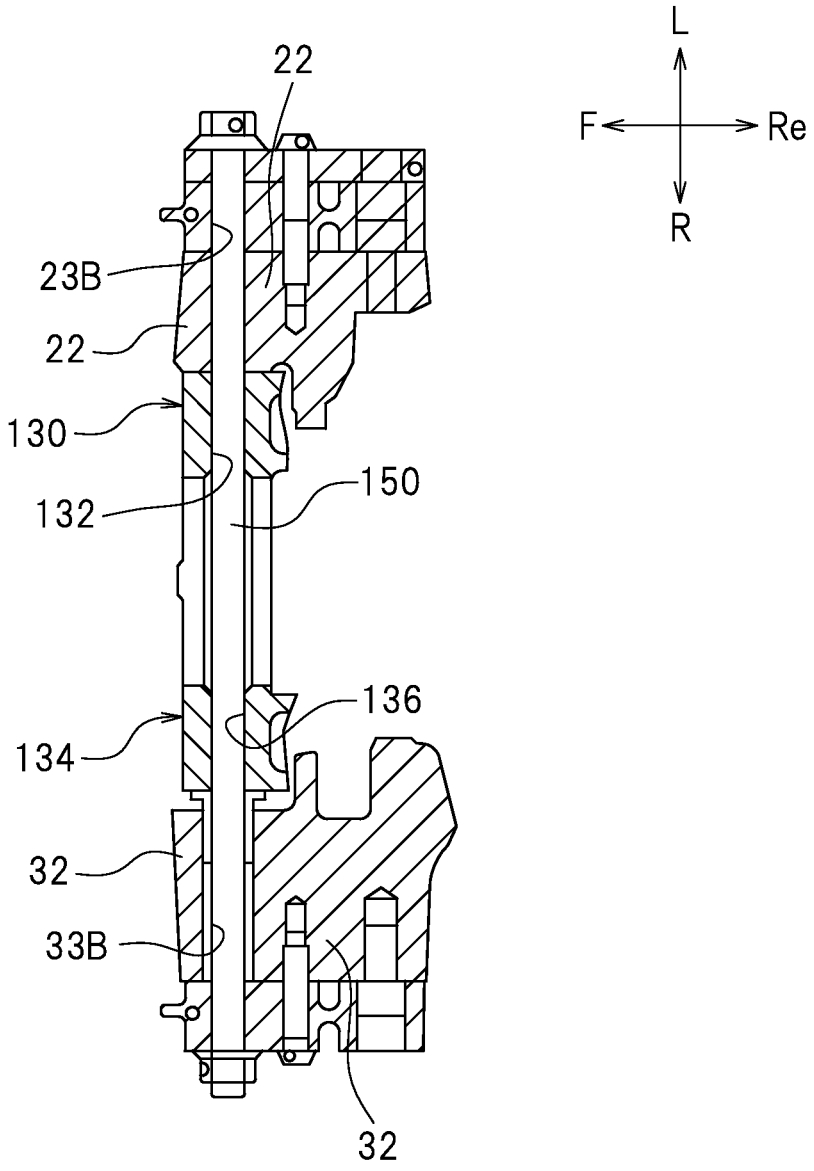
FIG. 4 is a cross-sectional view taken along line IV-IV in FIG. 2.
Figure 24:
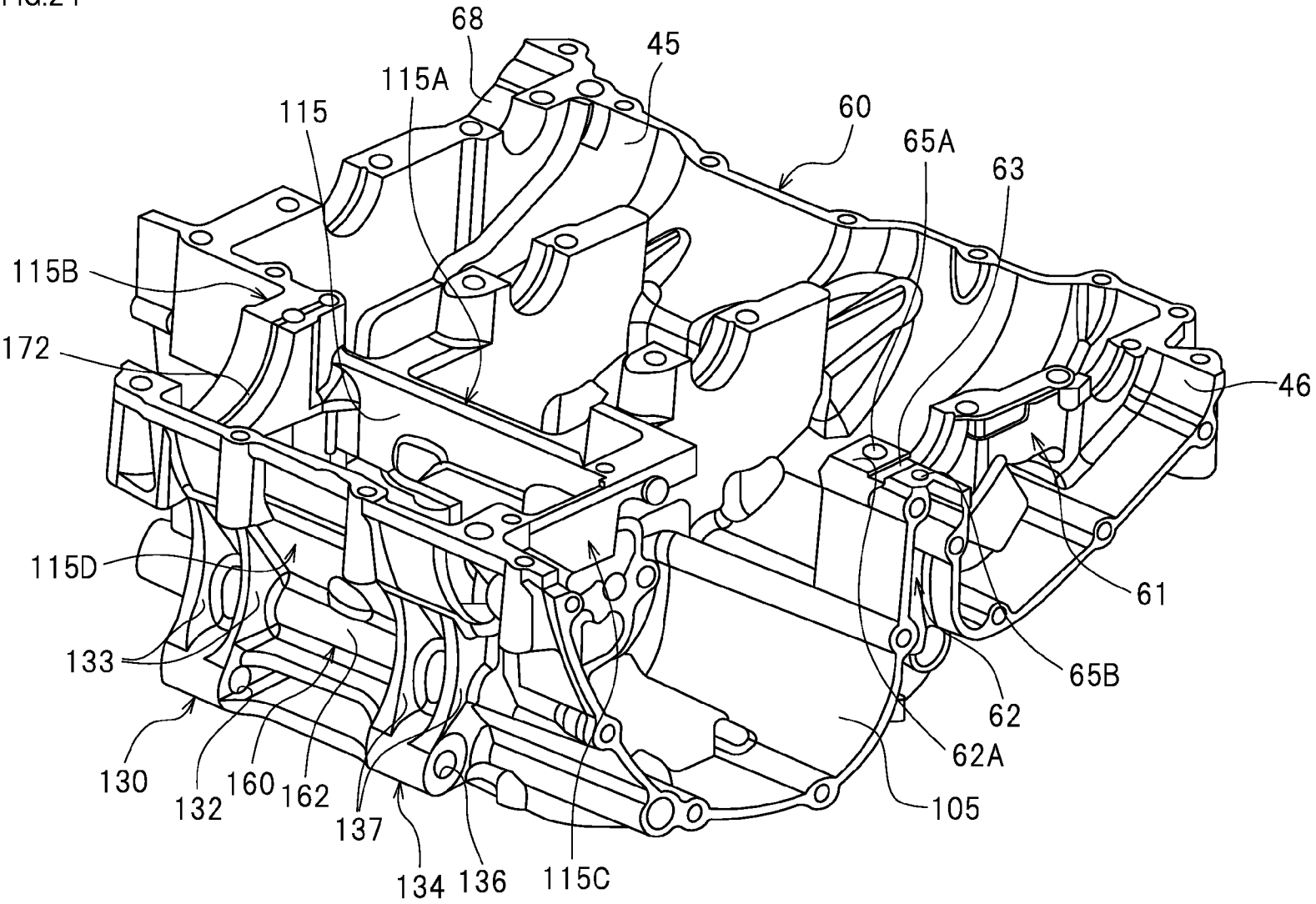
FIG. 24 is a perspective view of the lower crankcase according to a preferred embodiment of the present invention.

As illustrated in FIG. 24, the lower crankcase 60 includes a left boss portion 130 extending transversely direction and a right boss portion 134 extending transversely. The left boss portion 130 includes a hole 132 extending in a transverse direction. The right boss portion 134 includes a hole 136 extending in a transverse direction. As illustrated in FIG. 4, the left boss portion 130 is disposed between the left main frame 22 and the right main frame 32. The right boss portion 134 is disposed between the left main frame 22 and the right main frame 32 and to the right of the left boss portion 130. A rod-shaped fastener 150 extending transversely is inserted through a second left insertion hole 23B located in the left main frame 22, a second right insertion hole 33B located in the right main frame 32, and the hole 132 of the left boss portion 130, and the hole 136 of the right boss portion 134. Through the fastener 150, the left boss portion 130 of the lower crankcase 60 is secured to the left main frame 22, and the right boss portion 134 is secured to the right main frame 32. In the present preferred embodiment, the upper crankcase 50 includes the boss portion 120, and the lower crankcase 60 includes the left boss portion 130 and the right boss portion 134, for example. However, it is sufficient that at least one of the upper crankcase 50 and the lower crankcase 60 includes a boss portion. Moreover, the upper crankcase 50 may include the right and left boss portions, as with the lower crankcase 60, and the lower crankcase 60 may include only one boss portion, as with the upper crankcase 50.

Figure 25:
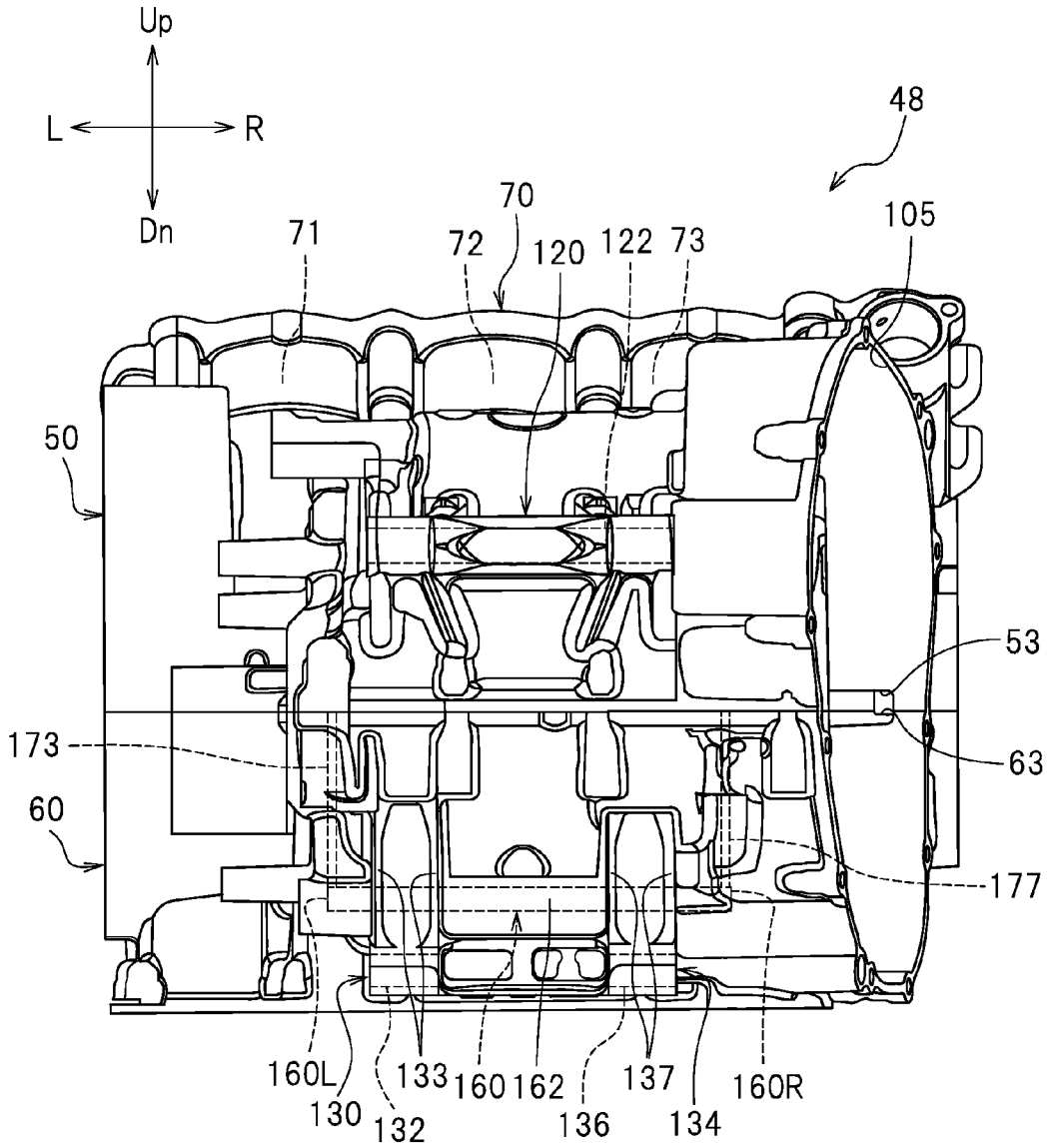
FIG. 25 is a rear view of the crankcase according to a preferred embodiment of the present invention.

As illustrated in FIG. 25, the lower crankcase 60 includes an oil passage 160 extending in a transverse direction. The oil passage 160 preferably is integrally formed with the lower crankcase 60 so as to be defined by a single monolithic member, for example. The oil to be supplied to the drive shaft 118 flows through the oil passage 160. In the present preferred embodiment, the left end 160L of the oil passage 160 is positioned more leftward than the left boss portion 130. The right end 160R of the oil passage 160 is positioned more rightward than the right boss portion 134. That said, it is sufficient that at least a portion of the oil passage 160 should be positioned between the left boss portion 130 and the right boss portion 134, as viewed from the rear of the motorcycle. For example, it is possible that the left end 160L of the oil passage 160 may be positioned more rightward than the left boss portion 130 and the right end 160R of the oil passage 160 may be positioned more leftward than the right boss portion 134. Alternatively, the left end 160L of the oil passage 160 may be linked to the left boss portion 130, and the right end 160R of the oil passage 160 may be linked to the right boss portion 134. As illustrated in FIG. 6, the oil passage 160 is disposed lower than the drive shaft 118 and higher than the left boss portion 130. As viewed from one side of the motorcycle, the oil passage 160 is disposed so that the center 160C of the oil passage 160 is positioned higher than the center 130C of the left boss portion 130 and lower than the center (axial center) 118C of the drive shaft 118. The oil passage 160 is disposed so that, as viewed from one side of the motorcycle, the distance T1 between the center 130C of the left boss portion 130 and the center 160C of the oil passage 160 is shorter than the distance T2 between the center 130C of the left boss portion 130 and the center 118C of the drive shaft 118. As viewed from one side of the motorcycle, the oil passage 160 does not overlap the gears 108G of the main shaft 108 and the gears 118G of the drive shaft 118. In the present preferred embodiment, the oil passage 160 is disposed so that, as viewed from one side of the motorcycle, the center 160C of the oil passage 160 is positioned more frontward than the center 130C of the left boss portion 130 and more rearward than the center 118C of the drive shaft 118. That said, the oil passage 160 may be disposed so that, as viewed from one side of the motorcycle, the center 160C of the oil passage 160 and the center 130C of the left boss portion 130 overlap each other. Alternatively, the oil passage 160 may be disposed so that, as viewed from one side of the motorcycle, the center 160C of the oil passage 160 overlaps the hole 132 of the left boss portion 130.

As illustrated in FIG. 8, the oil passage 160 is disposed so as to overlap the drive shaft 118, as viewed in plan of the motorcycle. The oil passage 160 is disposed so that, as viewed in plan of the motorcycle, a portion of the oil passage 160 overlaps a portion of the left boss portion 130 and a portion of the right boss portion 134. As illustrated in FIG. 25, the oil passage 160 is disposed so that, as viewed from the rear of the motorcycle, a portion of the oil passage 160 overlaps a portion of a first rib 133 and a portion of a second rib 137. In the present preferred embodiment, the oil passage 160 is disposed higher than the left boss portion 130 and the right boss portion 134, as illustrated in FIG. 25, and as viewed from the rear of the motorcycle, the oil passage 160 does not overlap the left boss portion 130 and the right boss portion 134. However, it is possible that the oil passage 160 may overlap the left boss portion 130 and the right boss portion 134, as viewed from the rear of the motorcycle.

As illustrated in FIG. 8, the transmission chamber 115 includes a front wall 115A, a left wall 115B, a right wall 115C, and a rear wall 115D. The left wall 115B extends rearward from the front wall 115A. The right wall 115C is positioned to the right of the left wall 115B and extends rearward from the front wall 115A. The rear wall 115D connects a rear end portion of the left wall 115B and a rear end portion of the right wall 115C. As illustrated in FIG. 24, a first rib 133 provided with the left boss portion 130 and a second rib 137 provided with the right boss portion 134 are formed on the rear wall 115D. The first ribs 133 and the second ribs 137 extend rearward and in a vertical direction, from the rear wall 115D. The oil passage 160 intersects with the first ribs 133 and the second ribs 137. As illustrated in FIG. 6, the front end portion 133A of each of the first ribs 133 is disposed more frontward than the oil passage 160.

As illustrated in FIG. 24, the oil passage 160 includes a first outer wall 162, which constitutes a portion of the outer surface of the lower crankcase 60. In the present preferred embodiment, the first outer wall 162 constitutes a portion of the outer surface of the rear wall 115D of the transmission chamber 115. As illustrated in FIG. 8, the oil passage 160 includes a second outer wall 164, which is positioned inward of the lower crankcase 60 and which constitutes a portion of the outer surface of the lower crankcase 60. In the present preferred embodiment, the second outer wall 164 constitutes a portion of the rear wall 115D of the transmission chamber 115.

Figure 26:
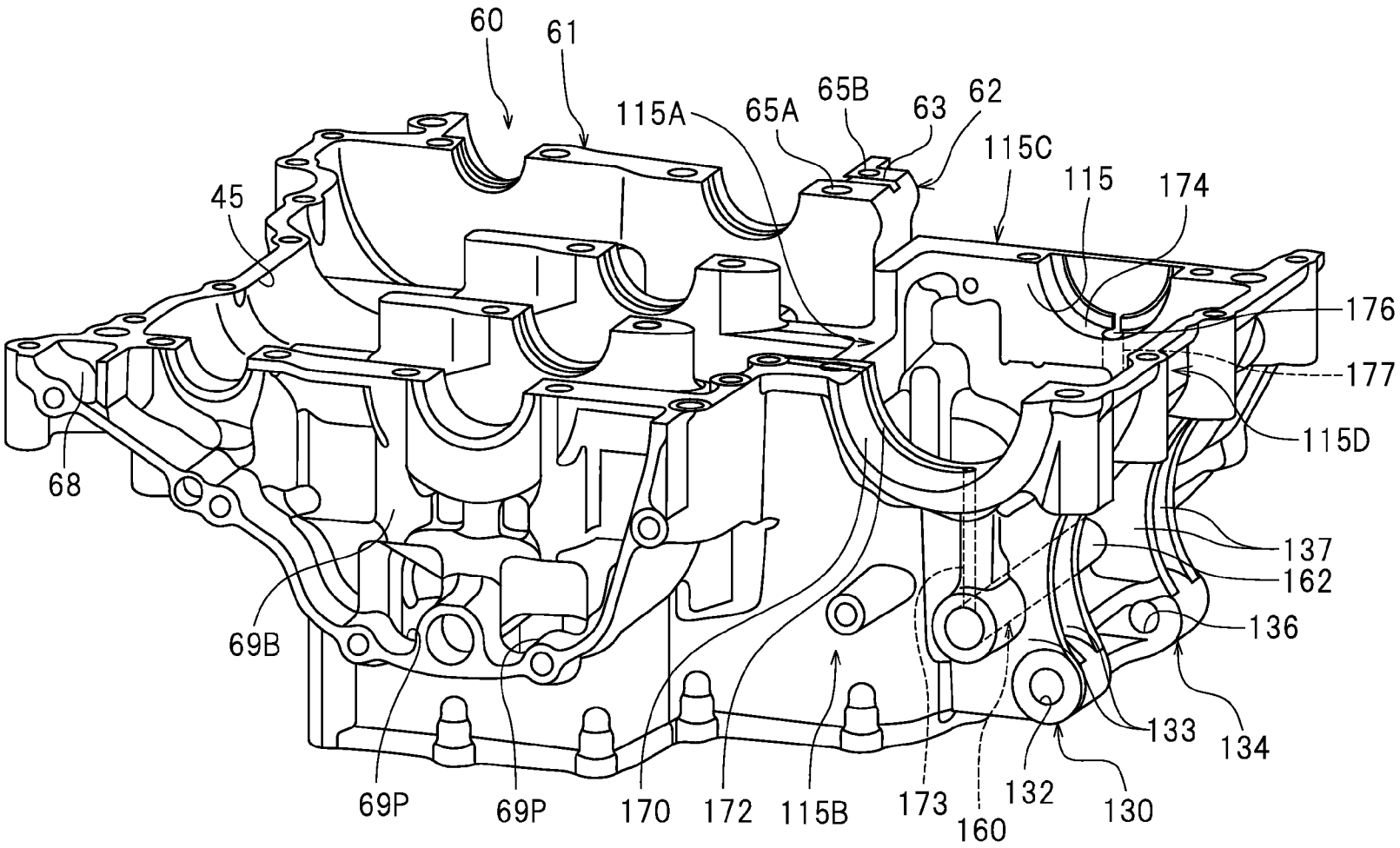
FIG. 26 is a perspective view of the lower crankcase according to a preferred embodiment of the present invention.

As illustrated in FIG. 26, the lower crankcase 60 includes drive shaft supporting surfaces 170 and 174 for supporting the drive shaft 118 (see FIG. 5). An oil groove 172 through which oil flows is provided in the drive shaft supporting surface 170. An oil groove 176 through which oil flows is provided in the drive shaft supporting surface 174. As illustrated in FIG. 25, the lower crankcase 60 includes a first communication passage 173 that allows communication between the oil passage 160 and the oil groove 172, and a second communication passage 177 that allows communication between the oil passage 160 and the oil groove 176. As illustrated in FIG. 7, the upper crankcase 50 includes drive shaft supporting surfaces 180 and 184 configured to support the drive shaft 118 (see FIG. 5). An oil groove 182 through which oil flows is provided in the drive shaft supporting surface 180.

As illustrated in FIG. 5, oil is supplied to the first communication passage 173 through the oil groove 172 (see FIG. 26), which is provided in the drive shaft supporting surface 170, by an oil pump, which is not shown in the drawings. The oil having been supplied to the first communication passage 173 flows through the oil passage 160, the second communication passage 177, and the oil groove 176 (see FIG. 26), as indicated by the arrow K in FIG. 5. A portion of the oil having been supplied to the oil groove 176 flows through the inside of the drive shaft 118, and is supplied to each of the gears 118G on the drive shaft 118.

In the present preferred embodiment, the oil passage 160 through which the oil having been supplied to the drive shaft 118 preferably is provided only in the lower crankcase 60. However, the oil passage 160 may be provided only in the upper crankcase 50, and it may be provided in both of the upper crankcase 50 and the lower crankcase 60, for example.

As described above, in the motorcycle 1 according to the present preferred embodiment, the first communication port 77 of the cylinder body 70 preferably is in communication with the first passage 93, through which at least one of oil and air flows. The first dowel pin 87 configured to perform positioning is fitted into the first communication port 77. The second communication port 78 of the cylinder body 70 is in communication with the second passage 94, through which at least one of oil and air flows. The second dowel pin 88 configured to perform positioning is fitted into the second communication port 78. In this way, the same holes are used both to provide positioning and to flow oil and the like. Therefore, it is not necessary to provide or form separate holes for these purposes. As a result, the layout of the cylinder body 70 is designed and manufactured much more efficiently, and the mounting surface 76 of the cylinder body 70 is prevented from increasing in size. In addition, the first communication port 77 is disposed in the front left region, and the second communication port 78 is disposed in the rear right region. The dowel pins configured to position the cylinder body 70 and the cylinder head 80 consist of the first dowel pin 87 fitted into the first communication port 77 and the second dowel pin 88 fitted into the second communication port 78. As a result, the limited space in the mounting surface 76 of the cylinder body 70 is utilized effectively, and the mounting surface 76 of the cylinder body 70 is prevented from increasing in size. For these reasons, the size of the internal combustion engine 40 as a whole is prevented from increasing, and weight reduction of the internal combustion engine 40 is achieved.

In the present preferred embodiment, as illustrated in FIG. 19, the cylinder body 70 preferably includes the first cylinder 71, the second cylinder 72, and the third cylinder 73. The greater the number of the cylinders is, the greater the size of the mounting surface 76 of the cylinder body 70. However, when the first communication port 77 and the second communication port 78 are provided as in the present preferred embodiment, the mounting surface 76 of the cylinder body 70 is prevented from increasing in size.

In the present preferred embodiment, as illustrated in FIG. 19, the first communication port 77 and the second communication port 78 are located at positions farther away from the first linear line L1 than the bolt insertion holes 75, in terms of the front-to-rear positional relationship in the cylinder body 70. This makes it possible to prevent the size increase of the mounting surface 76 of the cylinder body 70 that is caused by providing the first communication port 77 and the second communication port 78.

In the present preferred embodiment, as illustrated in FIG. 19, the first communication port 77 is disposed more leftward than the axial center 71C of the first cylinder 71, which is the leftmost one of the cylinders, and the second communication port 78 is disposed more rightward than the axial center 73C of the third cylinder 73, which is the rightmost one of the cylinders. This allows the positioning of the cylinder body 70 and the cylinder head 80 to be performed more reliably.

In the present preferred embodiment, in the mounting surface 76 of the cylinder body 70, the diameter A1 of the first communication port 77 and the diameter B1 of the second communication port 78 are greater than the diameter C1 of the bolt insertion holes 75, as illustrated in FIG. 19. This improves the flow of the oil and the like in the first communication port 77 and the second communication port 78.

In the present preferred embodiment, in the mounting surface 76 of the cylinder body 70, the diameter A1 of the first communication port 77 and the diameter B1 of the second communication port 78 are greater than the groove width D1 of the coolant passage 74, as illustrated in FIG. 19. This improves the flow of the oil and the like in the first communication port 77 and the second communication port 78.

In the present preferred embodiment, as illustrated in FIG. 21, the first communication port 77 includes the first main communication port 77A having an inner diameter A1 that is smaller than the outer diameter A3 of the first dowel pin 87, and the first sub-communication port 77B being in communication with the first main communication port 77A and having an inner diameter A2 that is greater than the outer diameter A3 of the first dowel pin 87. The first dowel pin 87 is fitted into the first sub-communication port 77B and the first passage 93. As illustrated in FIG. 22, the second communication port 78 includes the second main communication port 78A having an inner diameter B1 that is smaller than the outer diameter B3 of the second dowel pin 88, and the second sub-communication port 78B being in communication with the second main communication port 78A and having an inner diameter B2 that is greater than the outer diameter B3 of the second dowel pin 88. The second dowel pin 88 is fitted into the second sub-communication port 78B and the second passage 94. In this way, the first dowel pin 87 and the second dowel pin 88 do not fit into the first main communication port 77A and the second main communication port 78A, respectively. Therefore, the first dowel pin 87 and the second dowel pin 88 need not be secured to the first communication port 77 and the second communication port 78, respectively.

In the present preferred embodiment, as illustrated in FIGS. 21 and 22, the axial center 77C of the first communication port 77 and the axial center 87C of the first dowel pin 87 are in agreement with each other, and the axial center 78C of the second communication port 78 and the axial center 88C of the second dowel pin 88 are in agreement with each other. This improves the flow of the oil and the like in the first communication port 77 and the second communication port 78.

In the present preferred embodiment, as illustrated in FIG. 19, the cylinder body 70 includes the oil supply port 79 disposed more rearward than the first communication port 77 and more frontward than the second communication port 78. This simplifies the structure of the oil passage including the oil supply port 79 and improves the flow of the air and the like in the second communication port 78.

In the present preferred embodiment, as illustrated in FIG. 19, the cylinder body 70 extends frontward and obliquely upward, and the cam chain chamber 46 is disposed more rightward than the third cylinder 73, which is the rightmost one of the cylinders. The first communication port 77 is disposed in front of the first cylinder 71, which is the leftmost one of cylinders, and the second communication port 78 is disposed behind the third cylinder 73, which is the rightmost one of the cylinders. As a result, mainly oil flows through the first communication port 77, while mainly air flows through the second communication port 78.

Second Preferred Embodiment

Figure 27:
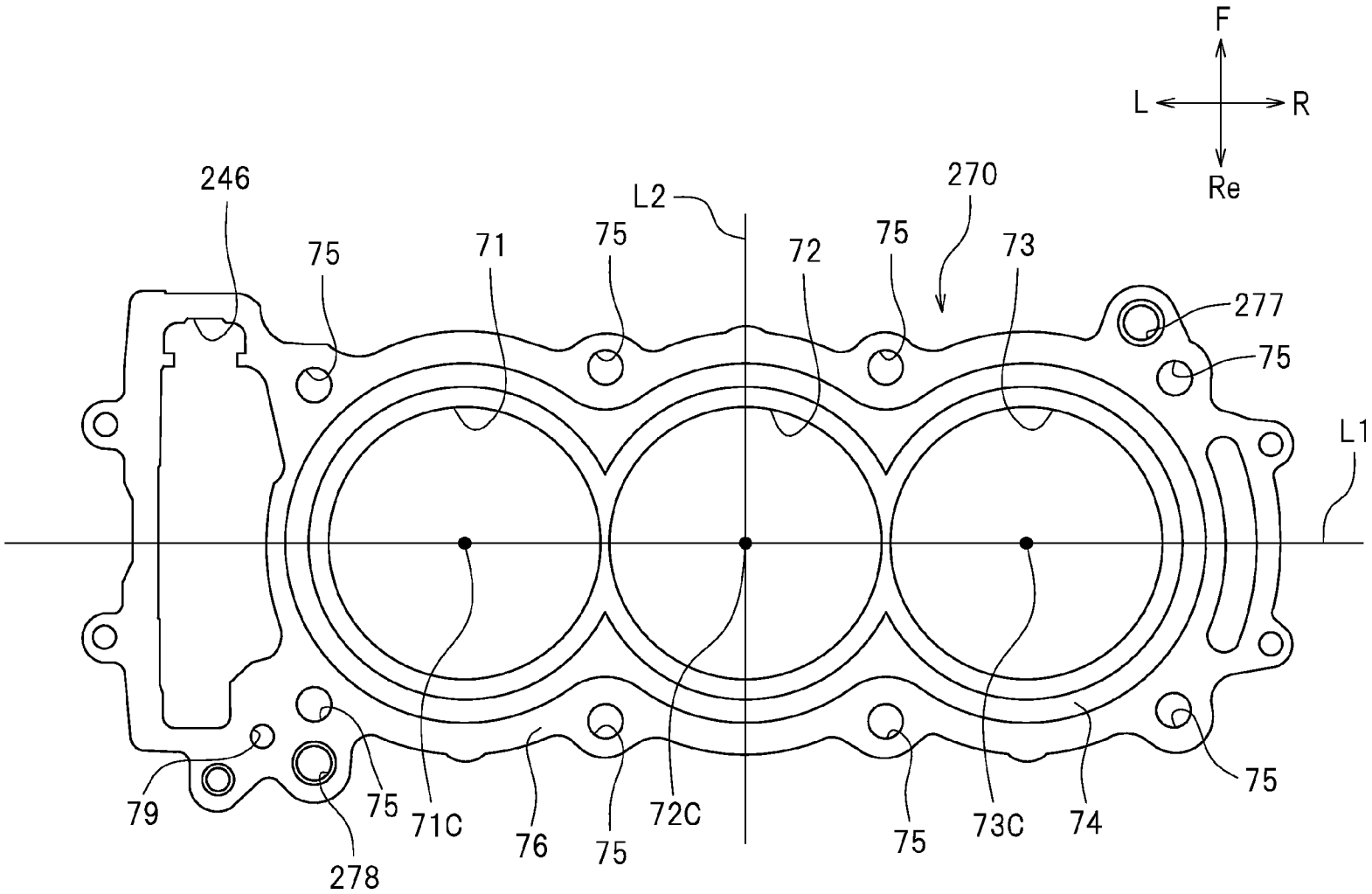
FIG. 27 is a plan view illustrating a mounting surface of a cylinder body according to a preferred embodiment of the present invention.

As illustrated in FIG. 27, in a cylinder body 270 according to the present preferred embodiment, a first communication port 277 is disposed in the front right region, and a second communication port 278 is disposed in the rear left region. A cam chain chamber 246 is disposed more leftward than the first cylinder 71, which is the leftmost one of the cylinders. It is preferable that the first communication port 277 be disposed more rightward than the axial center 73C of the third cylinder 73, which is the rightmost one of the cylinders. It is preferable that the first communication port 277 be disposed in front of the third cylinder 73, which is the rightmost one of the cylinders. It is preferable that the second communication port 278 be disposed more leftward than the axial center 71C of the first cylinder 71, which is the leftmost one of the cylinders. It is preferable that the second communication port 278 be disposed behind the first cylinder 71, which is the leftmost one of the cylinders.

In the present preferred embodiment, the first communication port 277 is disposed in the front right region, and the second communication port 278 is disposed in the rear left region. The dowel pins configured to position the cylinder body 270 and the cylinder head 80 consist of the first dowel pin 87 fitted into the first communication port 277 and the second dowel pin 88 fitted into the second communication port 278. As a result, the limited space in the mounting surface 76 of the cylinder body 270 is utilized effectively, and the mounting surface 76 of the cylinder body 270 is prevented from increasing in size.

In the present preferred embodiment, as illustrated in FIG. 27, the first communication port 277 is disposed more rightward than the axial center 73C of the third cylinder 73, which is the rightmost one of the cylinders, and the second communication port 278 is disposed more leftward than the axial center 71C of the first cylinder 71, which is the leftmost one of the cylinders. This allows the positioning of the cylinder body 270 and the cylinder head 80 to be performed more reliably.

In the present preferred embodiment, as illustrated in FIG. 27, the cam chain chamber 246 is disposed more leftward than the first cylinder 71, which is the leftmost one of the cylinders. The first communication port 277 is disposed more in front of the third cylinder 73, which is the rightmost one of the cylinders, and the second communication port 278 is disposed behind the first cylinder 71, which is the leftmost one of the cylinders. As a result, mainly oil flows through the first communication port 277, while mainly air flows through the second communication port 278.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A motorcycle comprising:

an internal combustion engine including:

a cylinder body including a plurality of cylinders arranged transversely;

a cam chain chamber accommodating a cam chain and being positioned to leftward of a leftmost one of the plurality of cylinders or rightward of a rightmost one of the plurality of cylinders;

a coolant passage surrounding the plurality of cylinders to flow coolant therethrough; and a plurality of bolt insertion holes located around the coolant passage and configured to receive bolts;

an engine member including a cylinder head disposed above the cylinder body or a crankcase disposed below the cylinder body, the engine member being secured to the cylinder body by the bolts and including first and second passages to flow at least one of oil and air therethrough; and a plurality of dowel pins configured to position the cylinder body and the engine member; wherein the cylinder body includes a mounting surface fitted to the engine member, a first communication port opening in the mounting surface and being in communication with the first passage, and a second communication port opening in the mounting surface and being in communication with the second passage;

in the mounting surface of the cylinder body, a linear line passing through an axial center of the plurality of cylinders is defined as a first linear line, a linear line passing through a midpoint of the axial center of the leftmost cylinder and the axial center of the rightmost cylinder and being perpendicular or substantially perpendicular to the first linear line is defined as a second linear line, a region that is in front of the first linear line and to the left of the second linear line is defined as a front left region, a region that is behind the first linear line and to the left of the second linear line is defined as a rear left region, a region that is in front of the first linear line and to the right of the second linear line is defined as a front right region, and a region that is behind the first linear line and to the right of the second linear line is defined as a rear right region, the first communication port is disposed in the front left region and the second communication port is disposed in the rear right region, or the first communication port is disposed in the front right region and the second communication port is disposed in the rear left region; and the plurality of dowel pins consist of a first cylindrical dowel pin fitted into the first communication port and the first passage and a second cylindrical dowel pin fitted into the second communication port and the second passage.

2. The motorcycle according to claim 1, wherein the cylinder body includes at least two of the plurality of cylinders.

3. The motorcycle according to claim 1, wherein the first communication port and the second communication port are located at positions farther away from the first linear line than the bolt insertion holes with respect to a front-to-rear positional relationship in the cylinder body.

4. The motorcycle according to claim 1, wherein the first communication port is disposed more leftward than the axial center of the leftmost one of the cylinders and the second communication port is disposed more rightward than the axial center of the rightmost one of the cylinders; or the first communication port is disposed more rightward than the axial center of the rightmost one of the cylinders and the second communication port is disposed more leftward than the axial center of the leftmost one of the cylinders.

5. The motorcycle according to claim 1, wherein, in the mounting surface of the cylinder body, a diameter of the first communication port and a diameter of the second communication port are each greater than a diameter of the bolt insertion holes.

6. The motorcycle according to claim 1, wherein, in the mounting surface of the cylinder body, a diameter of the first communication port and a diameter of the second communication port are each greater than a groove width of the coolant passage.

7. The motorcycle according to claim 1, wherein:

the first communication port includes a first main communication port having an inner diameter smaller than an outer diameter of the first dowel pin, and a first sub-communication port being in communication with the first main communication port and having an inner diameter greater than the outer diameter of the first dowel pin, and the first dowel pin is fitted into the first sub-communication port and the first passage; and the second communication port includes a second main communication port having an inner diameter smaller than an outer diameter of the second dowel pin, and a second sub-communication port being in communication with the second main communication port and having an inner diameter greater than the outer diameter of the second dowel pin, and the second dowel pin is fitted into the second sub-communication port and the second passage.

8. The motorcycle according to claim 1, wherein an axial center of the first communication port and an axial center of the first dowel pin are in alignment with each other, and an axial center of the second communication port and an axial center of the second dowel pin are in alignment with each other.

9. The motorcycle according to claim 1, wherein the cylinder body includes an oil supply port disposed more rearward than the first communication port and more frontward than the second communication port.

10. The motorcycle according to claim 1, wherein:

the cylinder body extends frontward and obliquely upward;

the cam chain chamber is disposed more rightward than the rightmost one of the plurality of cylinders; and the first communication port is disposed in front of the leftmost one of the plurality of cylinders, and the second communication port is disposed behind the rightmost one of the plurality of cylinders.

11. The motorcycle according to claim 1, wherein:

the cylinder body extends frontward and obliquely upward;

the cam chain chamber is disposed more leftward than the leftmost one of the plurality of cylinders; and the first communication port is disposed in front of the rightmost one of the plurality of cylinders, and the second communication port is disposed behind the leftmost one of the plurality of cylinders.

* * * * *